US008205646B2

(12) United States Patent
Isomura et al.

(10) Patent No.: US 8,205,646 B2
(45) Date of Patent: Jun. 26, 2012

(54) POWDER FILLING APPARATUS, POWDER FILLING METHOD AND PROCESS CARTRIDGE

(75) Inventors: Tetsuo Isomura, Kashiwa (JP); Manabu Jimba, Toride (JP); Masashi Koseki, Inashiki (JP); Kei Jomen, Iga (JP); Yutaka Ban, Tokyo (JP)

(73) Assignee: Canon Kabushiki Kaisha, Toyko (JP)

( * ) Notice: Subject to any disclaimer, the term of this patent is extended or adjusted under 35 U.S.C. 154(b) by 0 days.

(21) Appl. No.: 12/848,305

(22) Filed: Aug. 2, 2010

(65) Prior Publication Data

US 2010/0326564 A1 Dec. 30, 2010

Related U.S. Application Data

(63) Continuation of application No. 11/861,749, filed on Sep. 26, 2007, now Pat. No. 7,836,921, which is a continuation of application No. PCT/JP2007/054361, filed on Feb. 28, 2007.

(30) Foreign Application Priority Data

Feb. 28, 2006 (JP) ..... 2006-052216

(51) Int. Cl.
*B65B 31/00* (2006.01)

(52) U.S. Cl. ..... 141/64; 141/2; 141/63; 141/67; 141/286

(58) Field of Classification Search ..... 141/2, 8, 141/59, 63, 64, 65, 67, 192, 197, 198, 285, 141/286; 406/10, 28, 31
See application file for complete search history.

(56) References Cited

U.S. PATENT DOCUMENTS 3,265,098 A 8/1966 O'Neal et al.
3,782,695 A 1/1974 Sandiford
(Continued)

FOREIGN PATENT DOCUMENTS

JP 62-109702 A 5/1987
(Continued)

OTHER PUBLICATIONS

The Association of Powder Process Industry and Engineering, Japan, ed., Kaitei Zoho Funtai Bussei Zusetsu (Properties of Powders, Illustrated, Revised and Supplemented), pp. 151-155, 1985.
(Continued)

*Primary Examiner* — Timothy L Maust
(74) *Attorney, Agent, or Firm* — Fitzpatrick, Cella, Harper & Scinto

(57) ABSTRACT

A powder filling apparatus and a powder filling method which enable powder to be densely filled in a short period of time is to be provided. This is a powder filling apparatus having a pressure hopper wherein the pressure hopper has a discharger for discharging powder and a gas inlet positioned above at least the surface of a powder layer formed by the powder in the pressure hopper; the powder layer is so formed as to blockade the discharger in the pressure hopper; in the powder filling apparatus, the inside of the pressure hopper is pressurized by leading in gas through the gas inlet in a state in which the discharger is closed, and the powder layer so formed as to blockade the discharger is discharged by opening the discharger after the pressurization thereby to utilize that pressure to load the powder into the filling container.

4 Claims, 12 Drawing Sheets

U.S. PATENT DOCUMENTS

| | | | |
|---|---|---|---|
| 3,976,332 | A | 8/1976 | Fabel |
| 4,569,161 | A | 2/1986 | Shipman |
| 4,614,213 | A | 9/1986 | Englin |
| 4,703,782 | A | 11/1987 | Henkel, Sr. |
| 4,822,542 | A | 4/1989 | Kuwabara et al. |
| 4,863,316 | A | 9/1989 | Gianella et al. |
| 5,109,893 | A | 5/1992 | Derby |
| 5,234,037 | A | 8/1993 | Derby |
| 5,244,019 | A | 9/1993 | Derby |
| 5,275,215 | A | 1/1994 | Derby |
| 5,279,339 | A | 1/1994 | Derby |
| 5,316,056 | A | 5/1994 | Stott |
| 5,351,728 | A | 10/1994 | Ban et al. |
| 5,447,183 | A | 9/1995 | Derby |
| 5,475,479 | A | 12/1995 | Hatakeyama et al. |
| 5,509,451 | A | 4/1996 | Derby |
| 5,513,682 | A | 5/1996 | Derby |
| 5,518,048 | A | 5/1996 | Derby |
| 5,531,252 | A | 7/1996 | Derby et al. |
| 5,538,053 | A | 7/1996 | Derby |
| 5,711,353 | A | 1/1998 | Ichikawa et al. |
| 5,848,516 | A | 12/1998 | Ban |
| 5,961,856 | A | 10/1999 | Fusaro, Jr. et al. |
| 6,289,193 | B1 | 9/2001 | Ban et al. |
| 6,679,301 | B2 | 1/2004 | Makino et al. |
| 6,944,417 | B2 | 9/2005 | Yamada et al. |
| 6,963,713 | B2 | 11/2005 | Isomura et al. |
| 6,987,942 | B2 | 1/2006 | Yoshikawa et al. |
| 7,039,347 | B2 | 5/2006 | Yamada et al. |
| 7,054,581 | B2 | 5/2006 | Yoshikawa et al. |
| 7,079,788 | B2 | 7/2006 | Ban et al. |
| 7,190,925 | B2 | 3/2007 | Isomura et al. |
| 7,836,921 | B2 * | 11/2010 | Isomura et al. ..... 141/67 |
| 2005/0271426 | A1 | 12/2005 | Okino et al. |
| 2006/0174966 | A1 | 8/2006 | Facchini |
| 2007/0223972 | A1 | 9/2007 | Isomura |

FOREIGN PATENT DOCUMENTS

| | | | |
|---|---|---|---|
| JP | 3-226402 | A | 10/1991 |
| JP | 6-062121 | A | 3/1994 |
| JP | 7-100481 | A | 4/1995 |
| JP | 8-198203 | A | 8/1996 |
| JP | 11-049101 | A | 2/1999 |
| JP | 2002-293301 | A | 10/2002 |
| JP | 2002-337801 | A | 11/2002 |

OTHER PUBLICATIONS

International Preliminary Report on Patentability issued Sep. 12, 2008, in counterpart PCT Application No. PCT/JP2007/054361.

* cited by examiner

POWDER FILLING APPARATUS, POWDER FILLING METHOD AND PROCESS CARTRIDGE

This application is a continuation of U.S. application Ser. No. 11/861,749, filed Sep. 26, 2007, which is a continuation of International Application No. PCT/JP2007/054361 filed on Feb. 28, 2007, which claims the benefit of Japanese Patent Application No. 2006-052216 filed on Feb. 28, 2006.

BACKGROUND OF THE INVENTION

1. Field of the Invention

The present invention relates to a powder filling apparatus and a powder filling method for packing fine powder such as toner used in the developing device of an imaging apparatus such as an electrostatic copying machine or a printer, into a filling container, and a process cartridge packed with the powder by the powder filling method.

2. Description of the Related Art

Conventionally, fine powder such as toner is packed into a container to be filled with a powder with a screw feeder or an auger packer, by being let fall by its own gravity or by a pneumatic carrying device. For instance, Japanese Patent Application Laid-Open No. 2002-293301 describes an example of a pneumatic method of carrying powder.

Japanese Patent Application Laid-Open No. 2002-293301 discusses a configuration by which gas is led into powder stored in a powder feeding device to increase the fluidity of the powder and the powder is packed into a container to be filled by utilizing the pressure of the led-in gas. According to Japanese Patent Application Laid-Open No. 2002-293301, the powder in the powder feeding device is conveyed to a carrying tube by the pressure of leading-in, fed to the container to be filled via the carrying tube and, after the desired packed quantity is reached, the carriage of the powder is stopped by releasing the pressure in the powder feeding device.

However, in the configuration disclosed in Japanese Patent Application Laid-Open No. 2002-293301, as the powder stored in the powder feeding device is packed into the container to be filed after its fluidity is enhanced with the gas, the powder is fluidized more than required, making it difficult to pack the powder into the container to be filled in high density. The more than required fluidization also causes the filling to take a longer time than otherwise.

Another filling method by which powder is carried with gas without increasing the fluidity of the powder is proposed in Japanese Patent Publication No. H06-062121.

According to Japanese Patent Publication No. H06-062121, first a fixed quantity of powder is filled into a measuring chamber by the pressure in the measuring chamber being reduced, and pressure is applied from the upstream side of the measuring chamber in the powder carrying direction to load the powder with that pressure of application.

However, in the configuration discussed in Japanese Patent Publication No. H06-062121, as the filled quantity of powder is determined by the size of the measuring chamber, if filling is to be done into the same apparatus more than once in different quantities for instance, the measuring chamber itself will have to be replaced, entailing a heavy burden. Or if a large quantity of powder is to be filled, this configuration is susceptible to clogging of the filter with the filled powder at the stage of filling the measuring chamber under reduced pressure, making it difficult to load the prescribed quantity.

Also, Japanese Patent Application Laid-Open No. H03-226402 and Japanese Patent Publication No. H07-100481 describe configurations in which powder is filled into a filling container after being increased in density by being cleared of gas it contains.

Thus, according to Japanese Patent Application Laid-Open No. H03-226402, a hollow cylindrical container having an inner chamber and an outer chamber is filled with powder, followed by deaeration of the powder through a hole inner diameter in the inner chamber, and the powder, after being compacted, is filled into a flexible container to be filled underneath.

Further, Japanese Patent Publication No. H07-100481 discusses a configuration in which powder is filled by using a horizontal auger screw into a powder filling chamber having a similar filtering function, and deaeration is performed at the same time to load the powder in high density, followed by filling of the powder into a container to be filled.

Further, the following techniques are also made known as methods of filling powder into a container to be filled in high density.

Japanese Patent Application Laid-Open No. 2002-337801 describes a method by which air is gradually driven away upward from the bottom of a filling container while avoiding scattering of the powder by filling the powder in a state in which the filling nozzle of a powder filling apparatus is surrounded by the powder within the filling container. This method is claimed to be particularly effective for thin and narrow filling containers.

Also, Japanese Patent Application Laid-Open No. H08-198203 discusses a method by which powder is filled into a container to be filled in high density and at high speed by filling the powder while raising the air suction pipe of a powder filling apparatus from a state in which the pipe is inserted into the container in advance along with the progress of the filling of the powder and thereby sucking the gas contained in the powder.

SUMMARY OF THE INVENTION

An object of the present invention is to provide a powder filling apparatus and a powder filling method which enable powder to be filled in high density.

Another object of the present invention is to provide a powder filling apparatus and a powder filling method which enable powder to be filled in, a short period of time.

Another object of the present invention is to provide a process cartridge for electronic photography, filled with a developer by a powder filling method referred to above.

Thus, the invention relates to a powder filling apparatus having a pressure hopper wherein the pressure hopper has a discharger for discharging powder and a gas inlet positioned above at least the surface of a powder layer formed by the powder in the pressure hopper; the powder layer is so formed as to blockade the discharger in the pressure hopper; the inside of the pressure hopper is pressurized by leading in gas through the gas inlet in a state in which the discharger is closed, and the powder layer so formed as to blockade the discharger is discharged by opening the discharger after the pressurization thereby to utilize that pressure to fill the powder into the container to be filled (i.e., the filling container).

The invention also relates to a powder filling method executed by using a powder filling apparatus having a pressure hopper, characterized in that the pressure hopper has a discharger for discharging powder and a gas inlet positioned above at least the surface of a powder layer formed by the powder in the pressure hopper; the powder layer is so formed as to blockade the discharger in the pressure hopper; and the inside of the pressure hopper is pressurized by leading in gas through the gas inlet in a state in which the discharger is closed, and the powder layer so formed as to blockade the discharger is discharged by opening the discharger after the pressurization thereby to utilize that pressure to load the powder into the filling container.

The invention further relates to a powder filling method of filling powder into a filling container divided into a lid and a powder storage part characterized in that the rear end of a discharger which feeds powder into the filling container has a shape that is substantially the same as the shape required for the surface of the powder as it is filled in the powder storage part of the filling container, and filling is carried out with the surface of the powder in the powder storage part being adjusted to the required shape.

The invention also relates to a powder filling method of filling powder into a filling container divided into a lid and a powder storage part characterized in that the rear end of a discharger which feeds powder into the filling container has a shape that is substantially the same as the inside shape of the lid of the filling container, and filling is carried out with the surface of the powder in the powder storage part being adjusted to a shape substantially the same as the inside shape of the lid of the filling container.

Further the invention relates to a process cartridge for electronic photography, filled with a developer by a powder filling method referred to above.

By using the filling apparatus and filling method according to the invention, dense filling can be accomplished in a short period of time.

DESCRIPTION OF THE EMBODIMENTS

Figure 1:
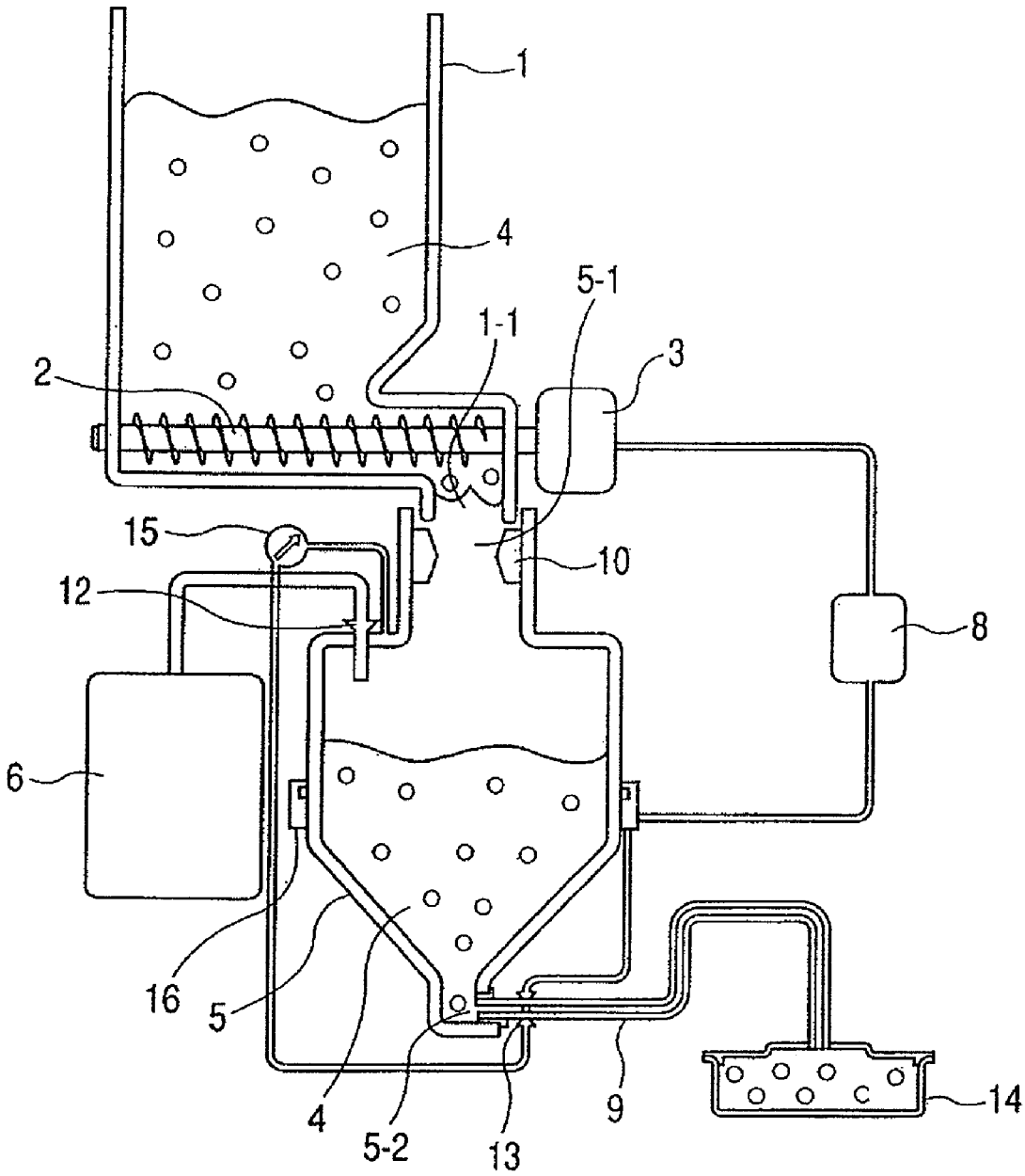
FIG. 1 is a schematic diagram of a filling apparatus in a first exemplary embodiment of the invention.

The present invention will be described below.

A first aspect of the invention relates to a powder filling apparatus having a pressure hopper wherein the pressure hopper has a discharger for discharging powder and a gas inlet positioned above at least the surface of a powder layer formed by the powder in the pressure hopper. The powder layer is so formed as to blockade the discharger in the pressure hopper. In this powder filling apparatus, the inside of the pressure hopper is pressurized by leading in gas through the gas inlet in a state in which the discharger is closed, and the powder layer so formed as to blockade the discharger is discharged by opening the discharger after the pressurization thereby to utilize that pressure to load the powder into the filling container.

In this powder filling apparatus according to the first aspect of the invention, filling into the filling container in higher density can be readily accomplished because powder increased in density is discharged by applying pressure in a state in which the discharger is closed to compress the power and then opening the discharger.

According to a second aspect of the invention, the powder filling apparatus according to the first aspect is provided, in at least part of the area in which the pressure hopper and the powder layer are in contact with each other, with a filter which passes air and intercepts powder, and gas contained in the powder layer within the pressure hopper is removed by this filter.

By using the powder filling apparatus according to the second aspect of the invention, the powder can be filled even more densely.

According to a third aspect of the invention, the powder filling apparatus according to the first aspect is provided with an auxiliary container for communicating with the pressure hopper and increasing the volume of the space which can be pressurized.

Use of the powder filling apparatus according to the third aspect results in adaptability to various filling volumes and thereby contributes to versatility of the apparatus.

According to a fourth aspect of the invention, in the powder filling apparatus according to the third aspect, a filter which passes air and intercepts powder is disposed between the pressure hopper and the auxiliary container.

Use of the powder filling apparatus according to the fourth aspect can serve to prevent the powder from permeating into the auxiliary container.

According to a fifth aspect of the invention, in the powder filling apparatus according to the third aspect, the auxiliary container is connected to the pressure hopper in a higher position than the surface of the powder layer.

Use of the powder filling apparatus according to the fifth aspect enables pressurized air in the auxiliary container to be efficiently used for carriage of the powder.

According to a sixth aspect of the invention, the powder filling apparatus according to the first aspect further has a detecting unit for detecting the filled quantity of powder in the filling container and a control unit which, when the filled quantity detected by the detecting unit has reached a prescribed level, temporarily stops the discharge of powder from the pressure hopper and after the temporary stop causes the filling to be resumed.

The powder filling apparatus according to the sixth aspect can serve to improve the accuracy of controlling the quantity of powder filled into the filling container by temporarily stopping the discharge of powder from the pressure hopper and resuming its filling after the powder has settled down.

According to a seventh aspect of the invention, in the powder filling apparatus according to the sixth aspect, detection of a decrease in the mass of the pressure hopper by the detecting unit causes the quantity of powder filled in the filling container to be detected.

The powder filling apparatus according to the seventh aspect can serve to enhance the versatility of the powder filling apparatus and to improve the accuracy of controlling the filled quantity of powder.

According to an eighth aspect of the invention, in the powder filling apparatus according to the first aspect, the rear end of the discharger which feeds powder into the filling container has a shape that is substantially the same as the shape required for the surface of the powder as it is filled in the filling container.

Here and in the further description of the invention, the rear end of the discharger may mean either the rear end of the discharger itself of the pressure hopper or the rear end of a carriage path, such as a tube, linked to the discharger of the pressure hopper. The rear end may also mean a member, such as a deaerator, connected to the discharger or the carriage path. The rear end means the end on the downstream side in the discharging direction of powder.

Use of the powder filling apparatus according to the eighth aspect enables the filled quantity of the powder to be further increased and the toner to be prevented from scattering when the lid is applied or in some other actions.

According to a ninth aspect of the invention, in the powder filling apparatus according to the first aspect, the rear end of the discharger which feeds powder into the filling container has a shape that is substantially the same as the inside shape of the lid of the filling container.

Use of the powder filling apparatus according to the ninth aspect enables the filled quantity of the powder to be further increased. Further, as the powder layer can be shaped substantially the same as the inside shape of the lid, the powder layer can be kept free from roughening by any convex of the lid when the lid is applied, and the toner can be prevented from being scattered to the joining face or the surroundings.

According to a 10th aspect of the invention, in the powder filling apparatus according to the eighth aspect, the rear end of the discharger which feeds powder into the filling container is provided with a deaerator which removes air from the inside of the filling container.

By using the powder filling apparatus according to the 10th aspect of the invention, the powder can be filled even more densely. Further, the powder can be prevented from scattering when the lid of the filling container is joined.

According to an 11th aspect of the invention, in the powder filling apparatus according to the ninth aspect, powder is filled into the filling container while the inside of a powder storage part is being deaerated by a deaerator, a filter having a shape that is substantially the same as the inside shape of the lid of the filling container is fitted to the rear end of the discharger which feeds powder into the filling container, and the deaeration is accomplished by the lid-shaped filter.

By using the powder filling apparatus according to the 11th aspect of the invention, the powder can be filled even more densely. Further, the powder can be prevented from scattering when the lid of the filling container is joined.

According to a 12th aspect of the invention, in the powder filling apparatus according to the first aspect, the rear end of the discharger which feeds powder into the filling container is provided with a sealing member for keeping the rear end in tight contact with the filling container.

Use of the powder filling apparatus according to the 12th aspect can prevent the powder being filled from leaking out of the filling container.

According to a 13th aspect of the invention, in the powder filling apparatus according to any of the first through 12th aspects, a reservoir for storing the powder is provided between the pressure hopper and the filling container, at least part of the wall face of the reservoir is formed of a reservoir filter which passes air and intercepts powder, and the reservoir has a shutter which seals a reservoir powder outlet through which the powder is discharged into the filling container.

By using the powder filling apparatus according to the 13th aspect of the invention, the powder can be filled even more densely. Further, the powder can be filled more quickly. Also, while filling the powder densely, the burden of the filling on the powder can be reduced. Smear of the apparatus by the powder can also be restrained.

According to a 14th aspect of the invention, in the powder filling apparatus according to the 13th aspect, a reservoir deaerator which deaerates the inside of the reservoir via the reservoir filter is connected.

By using the powder filling apparatus according to the 14th aspect of the invention, the powder can be filled even more densely and in a shorter period of time.

According to a 15th aspect of the invention, in the powder filling apparatus according to the 13th aspect, a reservoir air feeder which lets in air into the reservoir via the reservoir filter is connected.

By using the powder filling apparatus according to the 15th aspect of the invention, the quantity of powder sticking to the reservoir filter can be reduced to enhance the accuracy of filling. Moreover, the service life of the reservoir filter can be extended. In addition, the ventilating performance of the reservoir filter can be stabilized, and the accuracy of filling can be stabilized even after the endurance.

According to a 16th aspect of the invention, in the powder filling apparatus according to the 13th aspect, the size of the reservoir powder outlet is smaller than that of the powder filling inlet provided in the filling container.

By using the powder filling apparatus according to the 16th aspect of the invention, the occurrence of smear attributable to powder being filled from the reservoir into the filling container can be restrained.

A 17th aspect of the invention relates to a powder filling method executed by using a powder filling apparatus having a pressure hopper, characterized in that the pressure hopper has a discharger for discharging powder and a gas inlet positioned above at least the surface of a powder layer formed by the powder in the pressure hopper; the powder layer is so formed as to blockade the discharger in the pressure hopper; and the inside of the pressure hopper is pressurized by leading in gas through the gas inlet in a state in which the discharger is closed, and the powder layer so formed as to blockade the discharger is discharged by opening the discharger after the pressurization thereby to utilize that pressure to load the powder into the filling container.

By using the powder filling method according to the 17th aspect of the invention, filling of powder into the filling container can be accomplished in higher density and in a shorter period of time.

According to an 18th aspect of the invention, in the powder filling method according to the 17th aspect, the lead-in pressure of pressurizing the pressure hopper is 10 to 150 kPa.

By using the powder filling method according to the 18th aspect of the invention, filling of powder can be accomplished in a shorter period of time and in higher density.

According to a 19th aspect of the invention, in the powder filling method according to the 17th aspect, a filter which passes air and intercepts powder is provided in at least part of the area in which the pressure hopper and the powder layer are in contact with each other and, after the gas contained the powder layer within the pressure hopper is removed via the filter, powder is filled into the filling container.

By using the powder filling method according to the 19th aspect of the invention, filling of powder can be accomplished in still higher density.

According to a 20th aspect of the invention, in the powder filling method according to the 17th aspect, there is further provided an auxiliary container for communicating with the pressure hopper and increasing the volume of the space which can be pressurized.

By using the powder filling method according to the 20th aspect, the method can be adapted to many different filled quantities and the versatility of the powder filling apparatus can be enhanced.

According to a 21st aspect of the invention, in the powder filling method according to the 20th aspect, an auxiliary container filter which passes air and intercepts powder is disposed between the pressure hopper and the auxiliary container.

By using the powder filling method according to the 21st aspect, powder can be prevented from entering into the auxiliary container side.

According to a 22nd aspect of the invention, in the powder filling method according to the 20th aspect, the auxiliary container is connected to the pressure hopper in a higher position than at least the surface of the powder layer.

By using the powder filling method according to the 22nd aspect, the pressurizing air in the auxiliary container can be used for the carriage of powder efficiently.

According to a 23rd aspect of the invention, in the powder filling method according to the 17th aspect, reducing the discharged quantity of powder or stopping the discharge of powder from the discharger is involved at least once in the discharge of powder from the pressure hopper.

The powder filling method according to the 23rd aspect can serve to enhance the control accuracy of the quantity of powder filled into the filling container by temporarily suspending or slowing down the discharge of powder from the pressure hopper and resuming the filling after the powder is allowed to settle down.

According to a 24th aspect of the invention, in the powder filling method according to the 17th aspect, stopping the discharge of powder from the discharger is involved at least once in the discharge of powder from the pressure hopper and the duration of the discharge stop is not less than 0.2 seconds at a time.

The powder filling method according to the 24th aspect can serve to enhance the control accuracy of the quantity of powder filled into the filling container by temporarily suspending the discharge of powder from the pressure hopper and resuming the filling after the powder is allowed to settle down.

According to a 25th aspect of the invention, in the powder filling method according to the 24th aspect, the timing of stopping the discharge from the pressure hopper is when 70% to 95% of the ultimate quantity to be filled into the filling container has been discharged.

By using the powder filling method according to the 25th aspect, the accuracy of the quantity of powder filled into the filling container can be enhanced, and the filling can be accomplished in a shorter period of time. When the discharge is temporarily stopped at this timing, the pressurization within the pressure hopper is relatively low, which facilitates fine adjustment of the desired ultimate quantity to be filled.

According to a 26th aspect of the invention, in the powder filling method according to the 17th aspect, the quantity of powder in the pressure hopper before discharging is greater than the ultimate quantity to be filled into the filling container.

By using the powder filling method according to the 26th aspect, the control accuracy of the quantity of powder filled into the filling container can be enhanced. Eventually, by leaving some powder in the pressure hopper, the discharge outlet can be kept blocked until the end of filling, which enables stable filling utilizing the pressure in the pressure hopper.

According to a 27th aspect of the invention, in the powder filling method according to the 17th aspect, the quantity of powder filled in the filling container is detected by measuring the mass of the pressure hopper since the start of filling.

By using the powder filling method according to the 27th aspect, the control accuracy of the quantity of powder filled into the filling container can be enhanced.

According to a 28th aspect of the invention, in the powder filling method according to the 17th aspect, the rear end of the discharger which feeds powder into the filling container has a shape that is substantially the same as the shape required for the surface of the powder as it is filled in a powder storage part of the filling container, and filling is carried out with the surface of the powder in the powder storage part being adjusted to the required shape.

By using the powder filling method according to the 28th aspect, the filled quantity of powder can be further increased and, when a lid is to be put in place, the scattering of toner or the like can be restrained.

According to a 29th aspect of the invention, in the powder filling method according to the 17th aspect, the rear end of the discharger which feeds powder into the filling container has a shape that is substantially the same as the inside shape of a lid of the filling container, and filling is carried out with the surface of the powder in a powder storage part of the filling container being adjusted to substantially the same shape as the inside shape of the lid.

By using the powder filling method according to the 29th aspect, the filled quantity of powder can be further increased. Moreover, since the surface of the powder can be substantially the same as the inside shape of the lid, when the lid is to be put in place the powder layer is not deformed by the convex of the lid, and the toner is prevented from scattering onto or around the joint face, resulting in satisfactory joining.

According to a 30th aspect of the invention, in the powder filling method according to the 17th aspect, the filling container is filled with powder while the interior of the filling container is being deaerated.

By using the powder filling method according to the 30th aspect, powder can be filled even more densely.

According to a 31st aspect of the invention, in the powder filling method according to the 29th aspect, the filling container is filled with powder while the interior of the powder storage part is being deaerated with a deaerator, a lid-shaped filter having substantially the same shape as the inside shape of the lid of the filling container is fitted to the rear end of the discharger which feeds powder into the filling container, and deaeration is accomplished by the deaerator via the lid-shaped filter.

By using the powder filling method according to the 31st aspect, the filled quantity of powder can be further increased.

According to a 32nd aspect of the invention, in the powder filling method according to any of the 17th through 31st aspects, a reservoir for storing the powder is disposed between the pressure hopper and the filling container; at least part of the wall face of the reservoir is formed of a reservoir filter which passes air and intercepts powder; the reservoir has a shutter which seals the reservoir powder outlet through which the powder is discharged into the filling container; and the reservoir is filled with the powder from the pressure hopper in a state in which the reservoir powder outlet is sealed by the shutter and, by releasing the shutter afterwards, the powder is filled from the reservoir into the filling container.

By using the powder filling method according to the 32nd aspect, powder can be filled into the filling container even more densely. Powder can also be filled more quickly. Furthermore, while filling in high density, the burden of filling on the powder can be reduced. Also, the smear of the apparatus by the powder can be restrained.

According to a 33rd aspect of the invention, in the powder filling method according to the 32nd aspect, when powder is to be filled into the reservoir, the interior of the reservoir is deaerated from the reservoir filter by using the reservoir deaerator.

By using the powder filling method according to the 33rd aspect of the invention, filling of powder can be accomplished in still higher density and in a shorter period of time.

According to a 34th aspect of the invention, in the powder filling method according to the 32nd aspect, when powder in the reservoir is to be filled into the filling container, a reservoir air feeder is used to feed gas from the reservoir filter to the inside of the reservoir.

By using the powder filling method according to the 34th aspect of the invention, the quantity of powder sticking to the reservoir filter can be reduced to enhance the accuracy of filling. Moreover, the service life of the reservoir filter can be extended. In addition, the ventilating performance of the reservoir filter can be stabilized, and the accuracy of filling can be stabilized even after the endurance.

According to a 35th aspect of the invention, in the powder filling method according to the 32nd aspect, the size of the reservoir powder outlet is smaller than that of the powder filling inlet provided in the filling container.

By using the powder filling method according to the 35th aspect of the invention, the occurrence of smear attributable to powder being filled from the reservoir into the filling container can be restrained.

According to a 36th aspect of the invention, in the powder filling method according to the 17th aspect, the filling container has a filling container powder inlet for filling powder and a filling container deaerator for removing gas in a powder storing portion, the filling container deaerator being disposed in a higher position than the filling container powder inlet and the filling container deaerator being provided with a filling container deaerating filter which passes air and intercepts powder; and filling of powder into the filling container is carried out while aeration is performed by the filling container deaerator.

By using the powder filling method according to the 36th aspect of the invention, any drop in bulk density due to the dropping of powder can be restrained. Since the filling container deaerator is arranged in a higher position than the filling container powder inlet, deaeration can be smoothly accomplished, and denser filling into the powder storing portion can be accomplished in a short period of time.

According to a 37th aspect of the invention, in the powder filling method according to the 36th aspect, the filling container powder inlet is arranged at or near the lower end of the powder storing portion of the filling container in the vertical direction, and the filling container deaerator is arranged at or near the upper end of the powder storing portion in the vertical direction.

By using the powder filling method according to the 37th aspect of the invention, gas which is lower in specific gravity than toner can be efficiently and stably removed from within the powder storing portion, resulting in higher and more stable filling.

According to a 38th aspect of the invention, in the powder filling method according to any of the 17th through 35th aspects, the filling container has a powder storing portion for accommodating powder and a filling container deaerator, further having a filling assisting tube extending downward from the upper part of the powder storing portion in the vertical direction when the filling container is in the filling posture, and the filling container deaerator is arranged above the powder storing portion in the vertical direction; the rear end of the discharger which feeds powder into the filling container is connected to the upper end of the filling assisting tube; and powder is filled into the powder storing portion through the filling assisting tube while gas in the powder storing portion is being removed from the filling container deaerator.

By using the powder filling method according to the 38th aspect of the invention, powder discharged from the discharger can be filled into the powder storing portion from underneath, resulting in denser filling in a short period of time. The filling assisting tube provided for the powder storing portion enables the powder filling apparatus to be designed in a more space saving configuration, and at the same time scattering of powder during filling can be prevented.

According to a 39th aspect of the invention, in the powder filling method according to the 38th aspect, a connecting part between the upper end of the filling assisting tube and the rear end of the discharger which feeds powder into the filling container is provided with a tight seal for sealing the connecting part on at least one of the powder filling apparatus and the filling container.

By using the powder filling method according to the 39th aspect of the invention, powder discharged from the discharger can be guided without fail through the filling assisting tube toward the lower part of the powder storing portion even in the middle to late phase of filling, resulting in more stable filling of powder.

According to a 40th aspect of the invention, in the powder filling method according to the 38th aspect, the filling container deaerator is provided with a deaerator.

By using the powder filling method according to the 40th aspect of the invention, deaeration can be accomplished smoothly, and denser filling of powder into the powder storing portion can be achieved in a short period of time. Also, scattering of powder during filling can be prevented.

A 41st aspect of the invention relates to a powder filling method of filling powder into a filling container divided into a lid and a powder storage part characterized in that the rear end of a discharger which feeds powder into the filling container has a shape that is substantially the same as the shape required for the surface of the powder as it is filled in the powder storage part of the filling container, and filling is carried out with the surface of the powder in the powder storage part being adjusted to the required shape.

By using the powder filling method according to the 41st aspect of the invention, the filled quantity of powder can be increased.

A 42nd aspect of the invention relates to a powder filling method of filling powder into a filling container divided into a lid and a powder storage part characterized in that the rear end of a discharger which feeds powder into a filling container has a shape that is substantially the same as the inside shape of the lid of the filling container, and filling is carried out with the surface of the powder in the powder storage part being adjusted to a shape substantially the same as the inside shape of the lid.

By using the powder filling method according to the 42nd aspect of the invention, the filled quantity of powder can be increased. Also, the scattering of powder when the lid of the filling container is fitted can be prevented.

According to a 43rd aspect of the invention, in the powder filling method according to the 41st or 42nd aspect, filling of powder into the powder storage part is carried out while deaerating the interior of the powder storage part by using a deaerator.

By using the powder filling method according to the 43rd aspect, powder can be filled more densely.

According to a 44th aspect of the invention, in the powder filling method according to the 42nd aspect, filling of powder into the powder storage part is carried out while deaerating the interior of the powder storage part by using a deaerator, and a lid-shaped filter having substantially the same shape as the inside shape of the lid of the filling container is fitted to the rear end of the discharger which feeds powder into the filling container, and deaeration is accomplished by the deaerator via the lid-shaped filter.

By using the powder filling method according to the 44th aspect of the invention, the filled quantity of powder can be increased.

According to a 45th aspect of the invention, in the powder filling method according to the 43rd aspect, one or more holes are inner diameterd in the deaerator, and the powder is filled into the powder storage part through the hole or holes.

By using the powder filling method according to the 45th aspect, powder can be filled more densely.

According to a 46th aspect of the invention, in the powder filling method according to the 41st or 42nd aspect, filling of the powder is accomplished by having gas carry the powder.

By using the powder filling method according to the 46th aspect, powder can be filled more densely.

A 47th aspect of the invention relates to a process cartridge for electronic photography, the cartridge being filled with a developer by a powder filling method according to any of the 17th through 46th aspects. The process cartridge for electronic photography according to the 47th aspect of the invention is densely filled with a developer.

(Embodiment 1)

Next, a first exemplary embodiment of the invention will be described.

FIG. 1 shows an example of a filling apparatus system using a filling apparatus according to the invention. Referring to FIG. 1, a powder reservoir 1 stores a large quantity of powder 4 to be filled. A carrying unit 2 for carrying a regular quantity of the powder 4 is disposed underneath the powder reservoir 1; the carrying unit 2 is driven by a driving unit 3 and carries the powder 4 stored in the reservoir 1 to a pressure hopper 5 disposed underneath.

The pressure hopper 5 is equipped with a compressor 6, a driving control device 8, a carrying tube 9, a powder intake valve 10, a pressurizing valve 12, a powder discharge valve 13, an internal pressure gauge 15 and a load cell 16.

Powder 4 carried from the reservoir 1 is led into the pressure hopper 5 through a powder inlet 5-1 of the pressure hopper 5 by opening the powder intake valve 10. When this takes place, the carrying tube 9 is closed by the powder discharge valve 13. The load cell 16 is monitoring the weight of the pressure hopper 5. When a prescribed quantity of powder 4 has been led into the pressure hopper 5, information to that effect is transmitted from the load cell 16 to the driving control device 8, and a stop signal is issued from the driving control device 8 to the driving unit 3 to cause the driving unit 3 to stop driving.

After the prescribed quantity of powder 4 has been led into the pressure hopper 5, the intake valve 10 is closed to make the interior of the pressure hopper 5 airtight. Then, the compressor 6 is actuated and the pressurizing valve 12 is opened to pressurize the interior of the pressure hopper 5. When the pressurizing valve 12 is closed and the discharge valve 13 is opened after that, the powder 4 is shoved out of a powder outlet (discharger) 5-2, carried into the carrying tube 9 and shoved out through an end of the carrying tube 9. Connecting in advance the carrying tube 9 to a filling container 14 enables the powder 4 to be filled into the filling container 14.

The basic configuration of this filling apparatus has been described so far. Details of its constituent parts will be described below.

First, the pressure hopper 5 will be described.

In this exemplary embodiment of the invention, the pressure hopper 5 is an SUS-built vessel, of which the upper portion is cylindrical and the lower portion is conical. For the pressure hopper 5 to hold about 900 g of powder, it may have a capacity of 1500 to 3000 $cm^3$, and this particular embodiment used a pressure hopper of 2000 $cm^3$ in capacity. The lead-in pressure may be preferably 10 to 150 kPa, more preferably 35 to 120 kPa, and particularly preferably 35 to 100 kPa. The internal pressure of pressure hopper when subjected to pressure is the sum of the addition of 101.3 kPa (atmospheric pressure) to this lead-in pressure. The cylindrical powder inlet 5-1 is disposed at the top of the pressure hopper 5, and the powder intake valve 10 is provided inside the inlet. The powder inlet 5-1 and an opening 1-1 of the powder reservoir 1 are not connected to but separated from each other. The reason for this separation is that, as the weight of the pressure hopper 5 is monitored by the load cell 16, accurate detection of the weight requires separation of the powder inlet 5-1 from the opening 1-1. To prevent powder 4 from scattering from the separated part when the powder 4 is supplied to the pressure hopper 5, the powder inlet 5-1 may as well be built wider than the opening 1-1 to allow part of the tip of the opening 1-1 to be inserted into the powder inlet 5-1.

The compressor 6 is connected to the top of the pressure hopper 5 via the pressurizing valve 12.

Although the compressor 6 is connected to the top of the pressure hopper 5 in this embodiment, if the surface of the powder layer in the pressure hopper 5 is low, it may as well be arranged beside the pressure hopper 5 in a position higher than the surface of the powder layer.

The load cell 16 for detecting the weight of the pressure hopper 5 is disposed in a lower position beside the pressure hopper 5, and detects the quantity of powder 4 in the pressure hopper 5.

The powder outlet (discharger) 5-2 is disposed at the bottom end of the conical shape of the pressure hopper 5, and the carrying tube 9 serving as the carriage path is connected to the powder outlet (discharger) 5-2. As a result, powder 4 is shoved out by pressurized air within the pressure hopper 5, and carried from the powder outlet 5-2 to the carrying tube. The diameter of the powder outlet 5-2 is substantially equalized to that of the powder carrying tube 9 (about 8 mm in external diameter).

Next, the configuration of the compressor 6 will be described.

The compressor 6 is a device which applies pressure up to a set level to the pressure hopper 5, and the type used here permits adjustment of the set pressure with an accompanying pressure adjusting device (not shown).

The compressor 6 is connected to the top of the pressure hopper 5 via the pressurizing valve 12. By humidifying the air injected from the compressor 6, the increase in the quantity of static electricity of the developer along with the carriage can be restrained, especially where the developer is used by the developing device of an imaging apparatus such as an electrostatic copying machine or a printer.

Next, the configuration of the driving control device 8 will be described.

The driving control device 8 in this embodiment controls the carriage of powder 4 from the reservoir 1. First, a signal of driving start is sent from the driving control device 8 to the driving unit 3. Then the driving unit 3 starts driving, and powder 4 in the reservoir 1 begins to be carried. After that, when powder 4 is carried and its weight in the pressure hopper 5 has reached a prescribed level, a stop signal is sent from the driving control device 8 to the driving unit 3 to stop the carriage of powder 4. This control can keep the density of powder 4 in the pressure hopper 5 constant to some extent by making the weight of powder 4 in the pressure hopper 5 constant to some extent. The density kept constant eventually contributes to the accuracy of the filled quantity into the filling container 14. In this embodiment, about 900 g of powder 4 is filled into the unfilled pressure hopper 5, of which 400 g is filled into the filling container 14. The lead-in pressure to the pressure hopper was set to 40 kPa.

Next, the load cell 16 will be described.

In this embodiment, the load cell 16 is intended for detecting the weight of the pressure hopper 5. It detects the filled quantity of powder 4 in the pressure hopper before filling and the filled quantity of powder 4 in the filling container 14 once filling is started.

When powder is filled, the load cell 16 detects the difference in weight of the pressure hopper 5 between the start and the end of filling, and controls the filled quantity on that basis. Thus, when a prescribed pressure is applied into the pressure hopper 5, a signal is sent from the internal pressure gauge 15 to the powder discharge valve 13, the powder discharge valve 13 is opened to start filling. Later on, after the load cell 16 detects, on the basis of the difference from the initial weight of the pressure hopper 5, the filling of powder in a desired quantity into the filling container 14, a stop signal is sent from the load cell 16 to the powder discharge valve 13 to close the valve 13.

Although filling by only one round of control to open and close the powder discharge valve 13 has an advantage of reducing the time required for filling, a higher level of filling accuracy can be achieved by temporarily reducing the quantity of powder discharged from the discharger or temporarily stopping the filling on the way. More preferably, the discharging may be stopped for 0.5 seconds or longer. However, from the viewpoint of reducing the time required for filling, it is more preferable to keep the discharging stopped no longer than 1.0 second. When powder is filled in a process of closing the powder valve for about 0.5 seconds before the prescribed quantity is reached and reopening the valve to load the remainder, it is possible to enhance the accuracy of filling because the second stage of filling after the resumption is carried out slowly under reduced pressure in addition to the advantage of once settling the filled powder.

In testing this embodiment by filling 400 g of powder, a 350 g portion was filled in the first stage and, after keeping the valve closed for 0.5 second, the remaining 50 g was filled. As a result, a 400 g±3 g (397 g to 403 g) accuracy of the filled quantity which failed to be achieved by one stage filling was successfully attained.

Then, the load cell 16 detects filling of the prescribed quantity of powder 4, and the powder discharge valve 13 is closed. After that, the powder intake valve 10 is opened, a signal of driving start is sent from the driving control device 8 to the driving unit 3, and the re-supply of powder 4 from the reservoir 1 to the pressure hopper 5 is started, and the next filling is begun.

Next, the configuration of the carrying tube 9 will be described.

The carrying tube 9 is linked to the discharger of the pressure hopper 5 to constitute the carriage path for carrying powder to the filling container 14, and in this embodiment was a silicone tube of 6 mm in internal diameter and 8 mm in external diameter. Powder 4 shoved out of the pressure hopper 5 is carried to the filling container 14 by way of the carrying tube 9. The use of this tube enables the filling container 14 to be arranged in any desired position relative to the pressure hopper 5.

Next, the configuration of the powder discharge valve 13 will be described.

The powder valve 13 is opened in response to a signal from the internal pressure gauge 15 and is closed in response to a signal from the load cell 16. The powder valve 13 is configured of an electromagnetic valve, which closes the path by squeezing the carrying tube 9 and opens it by releasing the squeeze. Although the configuration of this embodiment has the powder valve 13 in the vicinity of the powder outlet 5-2 of the pressure hopper 5, the valve may as well be disposed on the filling container 14 side of the carrying tube 9. Also, though powder is filled into the filling container 14 by way of the carrying tube 9 in this embodiment, filling container may as well be directly connected to the discharger of the pressure hopper 5. In this case, the discharger of the pressure hopper 5 can be provided with a discharge valve to control the pressurized state in and the discharge of powder from the pressure hopper.

Next, the configuration of the filling container 14 will be described.

The filling container 14 has a portion to which the carrying tube 9 is connected, and powder 4 is filled into the filling container 14 through this portion. After the end of filling, the carrying tube 9 is removed from the filling container 14, and the hole used for filling into the filling container 14 is sealed with a cap, or by sticking another member or depositing a functional member such as a light guide.

Finally, powder 4 will be described.

Powder 4 that may be used in the powder filling apparatus or by the powder filling method may be, for instance, a developer used for electrophotographic apparatus. A nonmagnetic single-component developer is particularly suitable for use of this apparatus or method.

Powder, such as this developer, may have at least a Carr floodability index of 40 or more, more preferably 60 or more and still more preferably 80 or more.

The methods of measuring the Carr fluidity index and the Carr floodability index will be described below.

The Carr fluidity index and floodability index are measured with a PT-R type powder tester (a product of Hosokawa Micron Co., Ltd.) by a method stated in The Association of Powder Process Industry and Engineering, Japan, ed., Kaitei Zoho Funtai Bussei Zusetsu (Properties of Powders, Illustrated, Revised and Supplemented), pp. 151-155. The methods will be described below in more specific terms.

(Method of Measuring can Fluidity Index)

The following four items are measured, and the index of each is figured out according to the conversion table given as Table 1. The total of the indices so figured out shall be the fluidity index.

A) Repose angle

B) Compression

C) Spatula angle

D) Degree of cohesion

TABLE 1

| Repose angle | | Compression | | Spatula angle | | Cohesion | |
|---|---|---|---|---|---|---|---|
| Degree | Index | % | Index | Degree | Index | % | Index |
| <25 | 25 | <5 | 25 | <25 | 25 | | |
| 26 to 29 | 24 | 6 to 9 | 23 | 26 to 30 | 24 | | |
| 30 | 22.5 | 10 | 22.5 | 31 | 22.5 | | |
| 31 | 22 | 11 | 22 | 32 | 22 | | |
| 32 to 34 | 21 | 12 to 14 | 21 | 33 to 37 | 21 | | |
| 35 | 20 | 15 | 20 | 38 | 20 | | |
| 36 | 19.5 | 16 | 19.5 | 39 | 19.5 | | |
| 37 to 39 | 18 | 17 to 19 | 18 | 40 to 44 | 18 | | |
| 40 | 17.5 | 20 | 17.5 | 45 | 17.5 | | |
| 41 | 17 | 21 | 17 | 46 | 17 | | |
| 42 to 44 | 16 | 22 to 24 | 16 | 47 to 59 | 16 | <6 | 15 |
| 45 | 16 | 25 | 15 | 60 | 15 | | |
| 46 | 14.5 | 26 | 14.5 | 61 | 14.5 | 6 to 9 | 14.5 |
| 47 to 54 | 12 | 27 to 30 | 12 | 62 to 74 | 12 | 10 to 29 | 12 |
| 55 | 10 | 31 | 10 | 75 | 10 | 30 | 10 |
| 56 | 9.5 | 32 | 9.5 | 76 | 9.5 | 31 | 9.5 |
| 57 to 64 | 7 | 33 to 36 | 7 | 77 to 89 | 7 | 32 to 54 | 7 |
| 65 | 5 | 37 | 5 | 90 | 5 | 55 | 5 |
| 66 | 4.5 | 38 | 4.5 | 91 | 4.5 | 56 | 4.5 |
| 67 to 89 | 2 | 39 to 45 | 2 | 92 to 99 | 2 | 57 to 79 | 2 |
| 90 | 0 | >45 | 0 | >99 | 0 | >79 | 0 |

A) Method of Measuring Angle of Repose

Powder is dropped onto a disk of 8 cm in diameter via a funnel, and the angle of the conical accumulated layer that is formed is directly measured with a protractor. The feeding of the developer in this process is accomplished by arranging a sieve of 608 μm in opening (24 mesh) on the funnel, placing the powder on the sieve and vibrating the powder to let it drop into the funnel.

B) Method of Measuring Compression

The degree of compression C is calculated by the following equation.

$$C=[(\rho_P-\rho_A)/\rho_P]\times 100$$

In this equation, $\rho_A$ is the bulk density, which is measured by uniformly supplying the developer into a cylindrical container of 5.03 cm in diameter and 5.03 cm in height through a sieve of 608 μm in opening (24 mesh) from above and leveling the top surface.

Sign $\rho_P$ represents the tapping density. After measuring $\rho_A$, a cylindrical cap is fitted to the container, and powder is added to the top line of the cap, followed by 180 rounds of tapping at a tapping height of 1.8 cm. After the end of tapping, the cap is removed, the powder is leveled on the top surface of the container, and the density in this state is represented by $\rho_P$.

C) Method of Measuring Spatula Angle

A metallic spatula of 22 mm in width and 120 mm in length is set horizontally immediately above a saucer which moves up and down, and powder having passed a sieve of 608 μm in opening (24 mesh) is accumulated on the spatula. After the powder has sufficiently accumulated, the saucer is gradually lowered, and the angle of the profile of the powder having accumulated on the spatula is represented by A. Then, one impact is applied onto the arm supporting the spatula by dropping a weight, and the angle then measured again is represented by B. The average of A and B ((A+B)/2) is the spatula angle.

D) Method of Measuring Cohesion

The degree of cohesion is figured out by stacking sieves of three different openings in the descending order of opening size at the top, middle and bottom levels, placing 2 g of powder over them and measuring the remaining quantity of powder on the sieves after vibration of 1 mm in amplitude is applied. The sieves to be used are determined by the bulk density value. Where the bulk density is less than 0.4 g/cm$^3$, sieves of 355 μm (40 mesh), 263 μm (60 mesh) and 154 μm (100 mesh) in opening are used. Where the bulk density is not less than 0.4 g/cm$^3$ but less than 0.9 g/cm$^3$, sieves of 263 μm (60 mesh), 154 μm (100 mesh), 77 μm (200 mesh) in opening are used. Where the bulk density is not less than 0.9 g/cm$^3$, sieves of 154 μm (100 mesh), 77 μm (200 mesh), 43 μm (325 mesh) in opening are used.

The duration of vibration T (in seconds) is determined by the following equation.

$$T=20+\{(1.6-\rho_W)/0.016\}$$

$$\rho_W=(\rho_P-\rho_A)\times(C/100)+\rho_A$$

The degree of cohesion is calculated by the following equation into which the measured remaining quantities w1, w2 and w3 after vibration at the top, middle and bottom level are substituted.

$$C_0 = w1\times 100\times(1/2)+w2\times 100\times(1/2)\times(3/5)+w3\times 100\times(1/2)\times(1/5)$$

(Method of Measuring Carr Floodability Index)

The following four items are measured, and the index of each is figured out according to the conversion table given as Table 2. The total of the indices so figured out shall be the floodability index.

E) Fluidity

F) Collapse angle

G) Angle of difference

H) Dispersibility

TABLE 2

| Fluidity | | | | | | | |
|---|---|---|---|---|---|---|---|
| Index according to | | Collapse angle | | Angle of difference | | Dispersibility | |
| Table 1 | Index | Degree | Index | Degree | Index | % | Index |
| >60 | 25 | <10 | 25 | >30 | 25 | >50 | 25 |
| 59 to 56 | 24 | 11 to 19 | 24 | 29 to 28 | 24 | 49 to 44 | 24 |
| 55 | 22.5 | 20 | 22.5 | 27 | 22.5 | 43 | 22.5 |
| 54 | 22 | 21 | 22 | 26 | 22 | 42 | 22 |
| 53 to 50 | 21 | 22 to 24 | 21 | 25 | 21 | 41 to 36 | 21 |
| 49 | 20 | 25 | 20 | 24 | 20 | 35 | 20 |
| 48 | 19.5 | 26 | 19.5 | 23 | 19.5 | 34 | 19.5 |
| 47 to 45 | 18 | 27 to 29 | 18 | 22 to 20 | 16 | 33 to 29 | 18 |
| 44 | 17.5 | 30 | 17.5 | 19 | 17.5 | 28 | 17.5 |
| 43 | 17 | 31 | 17 | 18 | 17 | 27 | 17 |
| 42 to 40 | 16 | 32 to 39 | 16 | 17 to 16 | 16 | 26 to 21 | 16 |
| 39 | 15 | 40 | 15 | 15 | 15 | 20 | 15 |
| 38 | 14.5 | 41 | 14.5 | 14 | 14.5 | 19 | 14.5 |
| 37 to 34 | 12 | 42 to 49 | 12 | 13 to 11 | 12 | 18 to 11 | 12 |
| 33 | 10 | 50 | 10 | 10 | 10 | 10 | 10 |
| 32 | 9.5 | 51 | 9.5 | 9 | 9.5 | 9 | 9.5 |
| 31 to 29 | 8 | 52 to 56 | 8 | 8 | 8 | 8 | 8 |

TABLE 2-continued

| Fluidity | | | | | | | |
|---|---|---|---|---|---|---|---|
| Index according to | | Collapse angle | | Angle of difference | | Dispersibility | |
| Table 1 | Index | Degree | Index | Degree | Index | % | Index |
| <28 | 6.25 | 57 | 6.26 | 7 | 6.25 | 7 | 6.25 |
| 27 | 6 | 58 | 6 | 6 | 6 | 6 | 6 |
| 26 to 23 | 3 | 59 to 64 | 3 | 5 to 1 | 3 | 5 to 1 | 3 |
| <23 | 0 | >64 | 0 | 0 | 0 | 0 | 0 |

E) Fluidity

For the fluidity, the index is figured out by using the fluidity index.

F) Collapse Angle

The collapse angle is the angle of the slope formed after the collapse of the accumulated layer by a certain impact applied after measuring the angle of repose by the drop of a weight onto a rectangular bat mounted with an injection angle of repose base.

G) Angle of Difference

The angle of difference is the difference between the angle of repose and the collapse angle.

H) Dispersibility

Figure 8:
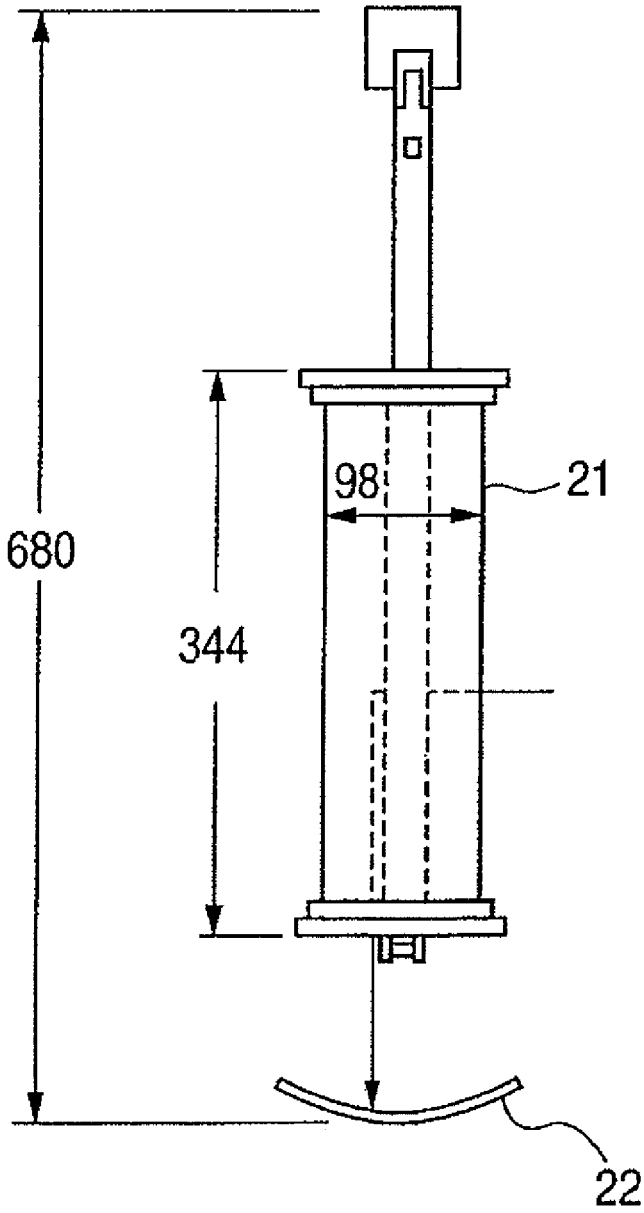
FIG. 8 is a schematic diagram of a dispersion degree measuring device.

Through a glass cylinder 21, measuring 98 mm in inner diameter and 344 mm in length as shown in FIG. 8, 10 g of powder is dropped all at once from the hopper installed above, and the quantity w (in grams) of powder having accumulated on a watch glass 22 is measured to figure out the dispersibility by the following equation.

$$\text{Dispersibility (\%)}=\{(10-w)/10\}\times 100$$

These physical properties are measured in an ambience of 50% in relative humidity and 20° C. in temperature.

Use of the powder filling apparatus described above enables powder 4 to be filled without raising the fluidity of powder 4 in the pressure hopper 5 more than necessary, and therefore powder can be carried at a higher density than with a conventional apparatus in which filling is accomplished by leading in gas from underneath the powder layer. As a result, denser filling can be achieved and the time required for filling can be reduced.

Since the pressure hopper 5 and the filling container 14 are connected by the carrying tube 9 in this configuration, the positional relationship between the pressure hopper 5 and the filling container 14 can be arranged as desired. Furthermore, as the interior of the pressure hopper 5 is pressurized when powder 4 is carried, the filling container 14 can be arranged in a higher position than the pressure hopper 5.

Therefore, the whole filling apparatus can be designed in a more compact shape and, regarding the filling method, an arrangement which facilitates the operator's filling work can be used with the result that the filling apparatus and the filling method can meet both requirements at the same time.

(Embodiment 2)

Next, a second exemplary embodiment of the invention will be described.

Figure 2:
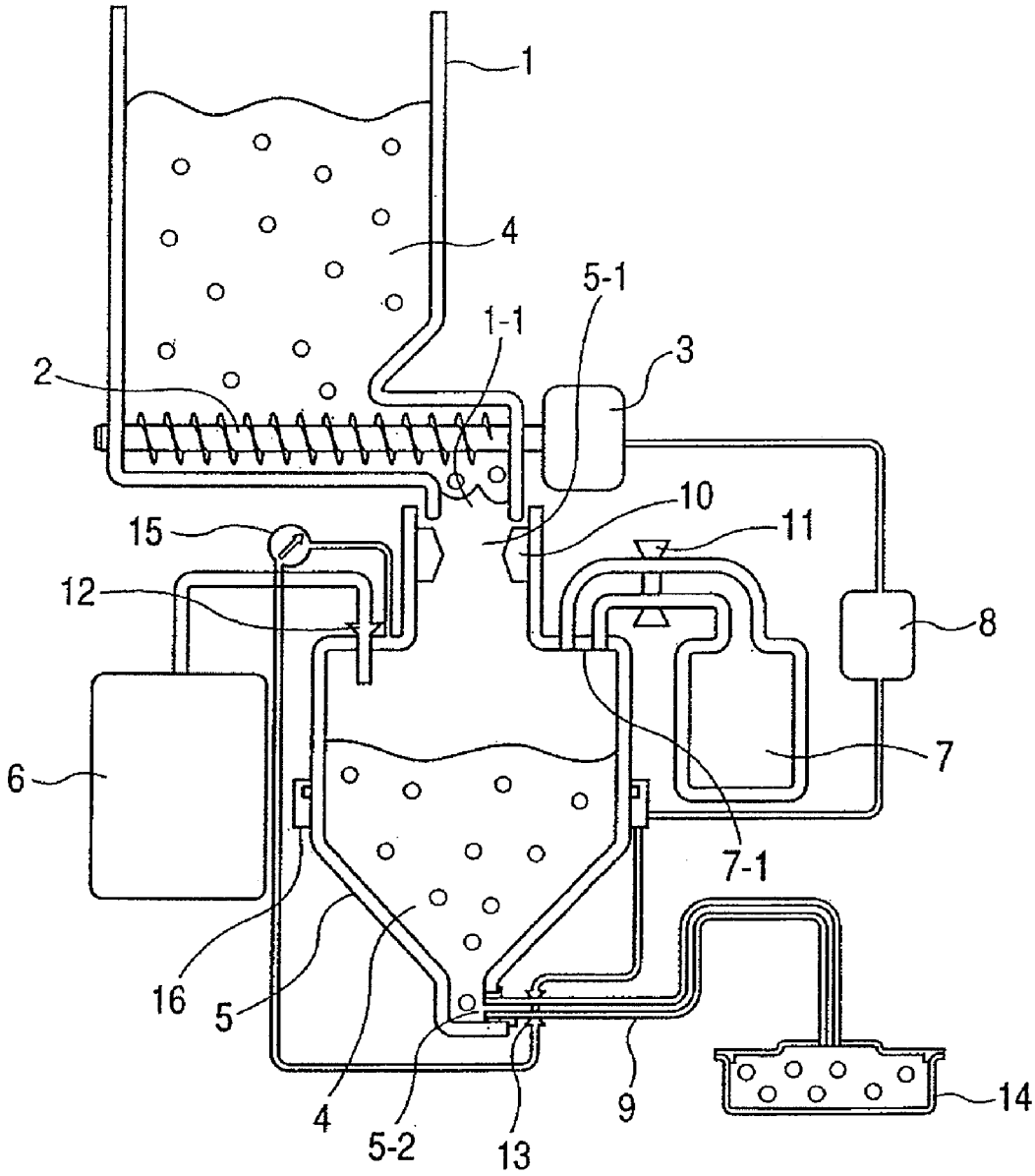
FIG. 2 is a schematic diagram of a filling apparatus in a second exemplary embodiment.

FIG. 2 shows an example of filling apparatus in a second exemplary embodiment of the invention. Referring to FIG. 2, the powder reservoir 1, pressure hopper 5, compressor 6, driving control device 8, carrying tube 9, powder intake valve 10, pressurizing valve 12, powder discharge valve 13, internal pressure gauge 15, load cell 16 and some other constituent elements are the same as their respective counterparts in Embodiment 1, and therefore their description will be dispensed with. The same kind of powder referred to in the description of Embodiment 1 can be used as powder 4.

A characteristic aspect of the filling apparatus, which is the second embodiment, lies in that an auxiliary container 7 and an auxiliary container valve 11 are linked to the pressure hopper 5.

The configuration of the auxiliary container 7 will be described with reference to FIG. 2.

As shown in FIG. 2, the auxiliary container 7 is connected to the top of the pressure hopper 5. The purpose of this arrangement is to prevent powder 4 from entering into the auxiliary container 7. If the surface of the powder layer within the pressure hopper 5 is low, the auxiliary container 7 may as well be located on the cylindrical face of a side of the pressure hopper 5 in a position higher than the surface of the powder layer.

A connecting part of the auxiliary container 7 is provided with a filter 7-1 which passes air but not powder. The presence of the filter 7-1 serves to prevent powder 4 from entering into the auxiliary container 7. If powder 4 enters into the auxiliary container 7, the powder would not only be prevented from being carried to the filling container 14 but also reduce the capacity of the auxiliary container 7, both being undesirable consequences. However, the filter 7-1 is not an indispensable constituent element of this filling apparatus, which could do without it. There is no particular limitation regarding the filter type, but any filter that can separate air from powder can be used.

Similarly, by arranging the connecting part of the auxiliary container 7 in a position always higher than the surface of the powder layer, the pressurized air in the auxiliary container 7 can be caused to act so as to shove out powder from behind the powder outlet 5-2 and thereby enable the auxiliary container 7 to fully perform its function.

In the powder filling apparatus according to the invention, the lead-in pressure to the pressure hopper 5 being supposed to be constant, the carried quantity of powder 4 is dependent on the capacity of the pressure hopper 5. If the powder 4 is a developer for use by the developing device of an imaging apparatus such as an electrostatic copying machine or a printer, the loadable quantity varies from one product to another according to the specifications of the product. To ensure adaptability to the group of products differing in loadable quantity, the auxiliary container 7 is connected to the pressure hopper 5 via auxiliary container valve 11. Thus, when a product with a large loadable quantity is filled with powder 4, the full capacity of the auxiliary container 7 can be used by opening the auxiliary container valve 11, resulting in an apparent increase in the capacity of the pressure hopper 5. For this reason, even if the lead-in pressure into the pressure hopper 5 is set to the same level, the eventual carriable quantity of powder 4 can be increased.

If the capacity of the auxiliary container 7 is made variable, its versatility can be further enhanced, resulting in a more desirable configuration.

While the carriable quantity of powder 4 can be expanded by increasing the lead-in pressure, a significant increase in lead-in pressure would invite an expansion in the carried quantity of powder 4 per hour, and this would make it difficult to control the filled quantity of powder 4, resulting in a drop in the accuracy of filled quantity.

On the other hand, if the lead-in pressure is lowered, the carried quantity of powder 4 per hour will become too small, inviting an extension of the length of time required for filling.

Thus, in order to optimize the accuracy of the filled quantity and the length of time required for filling, the injecting pressure may be adjusted within a reasonable range, and in this adjusting arrangement, the filled quantity powder 4 cannot be substantially varied unless the capacity of the pressure hopper 5 is made variable.

To address this problem, the auxiliary container 7 is provided to make the apparent capacity of the pressure hopper 5 larger, with the result that the filling apparatus can be made adaptable to a wide variety of filled quantities while being able to stably perform filling at high accuracy.

In this embodiment, if the quantity of powder 4 held in the pressure hopper 5 before filling is about 900 g, 600 g of that quantity is filled into the filling container 14. In the tested example, the pressure hopper was 2000 $cm^3$ in capacity, the auxiliary container 7 was 1000 $cm^3$, and the lead-in pressure to the pressure hopper linked to the auxiliary container was 40 kPa. To load powder of 600 g in total quantity, 550 g was filled onto the first stage and, after closure for 0.8 seconds, the remaining 50 g was filled. As a result, a 600 g ±3 g (597 g to 603 g) accuracy of the filled quantity was successfully achieved.

(Embodiment 3)

Next, a third exemplary embodiment of the invention will be described.

Figure 3:
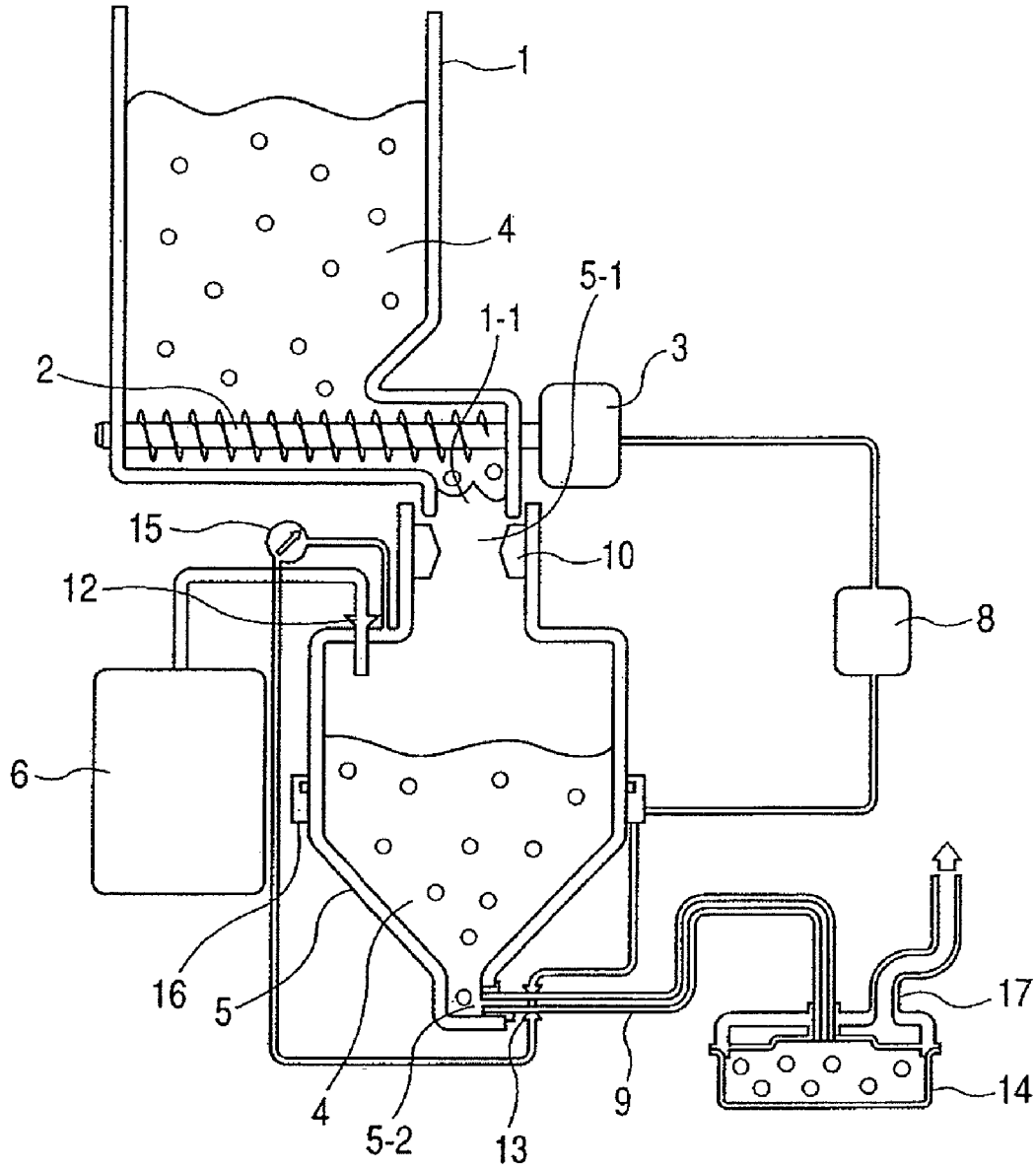
FIG. 3 is a schematic diagram of a filling apparatus in a third exemplary embodiment.

FIG. 3 shows an example of filling apparatus in a third exemplary embodiment of the invention. Referring to FIG. 3, the powder reservoir 1, pressure hopper 5, compressor 6, driving control device 8, carrying tube 9, powder intake valve 10, pressurizing valve 12, powder discharge valve 13, internal pressure gauge 15, load cell 16 and some other constituent elements are the same as their respective counterparts in Embodiment 1, and therefore their description will be dispensed with. The same kind of powder referred to in the description of Embodiment 1 can be used as powder 4.

A characteristic aspect of the filling apparatus, which is the third embodiment, lies in that the rear end of the carriage path (the carrying tube 9) linked to the discharger which feeds powder into the filling container is formed of a deaerator 17 having a deaerating filter which has a shape that is substantially the same as the shape required for the surface of the powder layer as it is filled in the powder storage part of the filling container. Although the deaerator to be described afterwards is disposed at the rear end of the carrying tube and the shape of this deaerator is in the desired surface shape of the powder layer in the case illustrated in FIG. 3, if shaping of the powder layer surface in the filling container is the only purpose, this element need not have a deaerating mechanism. Nor is required linking of the carrying tube 9 as in FIG. 3, but the rear end of the discharger of the pressure hopper 5 may directly have a deaerator.

Figure 5:
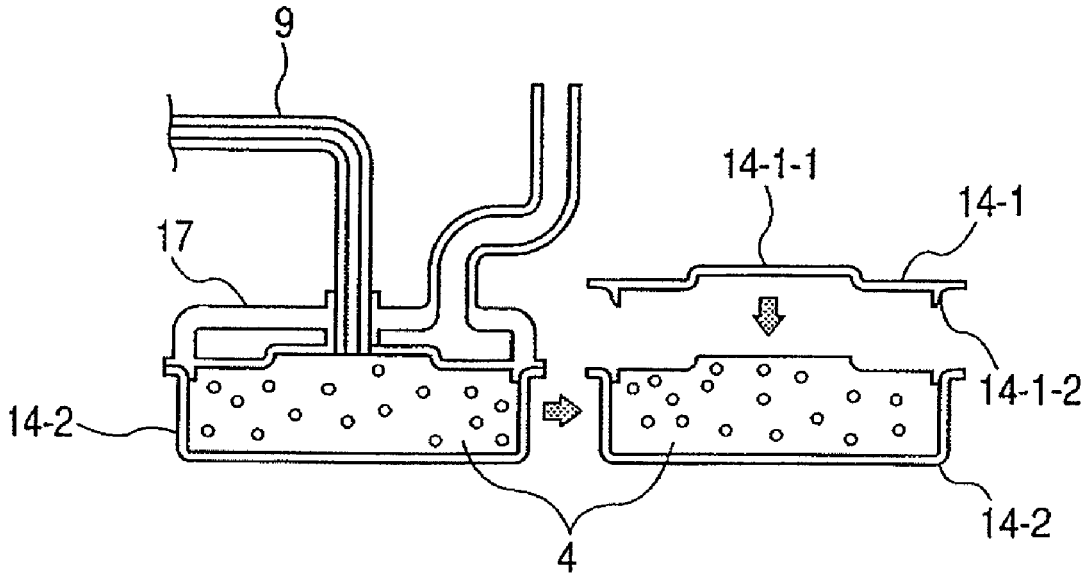
FIG. 5 illustrates the step of fitting a lid 14-1 in the third exemplary embodiment.

When powder is filled by using such a powder filling apparatus, a filling container 14 comprising a lid 14-1 and a powder storage part 14-2 is used (see FIG. 5).

When powder is to be filled, the lid 14-1 of the filling container is removed, and the rear end whose shape is substantially the same as the shape required for the surface of the powder layer filled in the powder storage part 14-2 of the filling container 14 is joined to the powder storage part 14-2 to perform powder filling.

Figure 4:
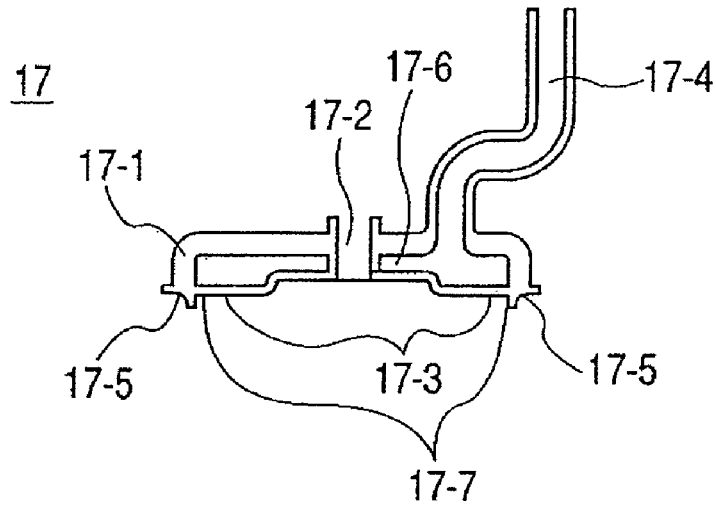
FIG. 4 illustrates details of a deaerator 17 in the third exemplary embodiment.

Next, the configuration of the deaerator 17 will be described with reference to FIG. 4.

The deaerator 17 has a deaerator frame 17-1, a powder intake 17-2, a lid-shaped filter (deaerating filter) 17-3 (a filter concave 17-6 and a filter convex 17-7), a negative pressure connector 17-4 and a deaeration packing 17-5.

The deaerator frame 17-1, having a shape following the joint between the lid 14-1 and the powder storage part 14-2 of the filling container 14, is fitted to the powder storage part 14-2 from above. The fitting portion is provided with the deaeration packing 17-5 to make the fit tight. On the reverse side of the deaerator frame 17-1 to the joint, the negative pressure connector 17-4 is disposed, and this part is connected to the negative pressure source to achieve deaeration.

Although only one powder intake 17-2 is provided in this embodiment at the center, a plurality of powder intakes 17-2 may be provided as well to increase the filling speed, and the position need not be at the center, but positioning at an edge would also be acceptable.

A five-layered metal sintered filter is used as the lid-shaped filter 17-3, and its openings are, from the side in contact with the powder 4 onward, 150 μm (100 mesh) both in length and width in the first layer, 7.5 μm (2000 mesh) long and 10.7 μm (1400 mesh) wide in the second layer, 150 μm (100 mesh) both in length and width in the third layer, 1400 μM (12 mesh) long and 234 μm (64 mesh) wide in the fourth layer, and 1400 μm (12 mesh) long and 234 μm (64 mesh) wide in the fifth layer. However, the configuration of the lid-shaped filter 17-3 is not limited to this, but any configuration which does not pass powder 4 but does pass gas can be used.

The use of such a deaerator 17 enables gas, mainly contained in the powder layer, to be removed in the filling container 14, resulting in highly dense filling of powder 4.

Next, joining of the lid 14-1 will be described with reference to FIG. 5.

When filling of a prescribed quantity of powder 4 into the powder storage part 14-2 has been detected, the powder discharge valve 13 is closed to stop the discharge of powder 4. After that, the deaerator 17 is detached from the powder storage part 14-2, and the separately prepared lid 14-1 and the powder storage part 14-2 are joined. The joining of this lid 14-1 and the powder storage part 14-2 is accomplished by, for instance, ultrasonic deposition, which is a known procedure, or otherwise.

The use of the deaerator 17 facilitates formation of the surface shape of the powder layer filled in the powder storage part 14-2 in substantially the same as the inside shape of the lid 14-1. Where a lid having a concave and a convex is to be used, advance shaping of the surface of the powder layer filled in the powder storage part 14-2 is desirable. For instance, where the lid 14-1 has a concave 14-1-1, by providing the lid-shaped filter 17-3 with a concave 17-6 matching that concave, powder can be filled even into that concave 17-6, resulting in an increase in the overall quantity of the filled powder. Or where the lid 14-1 has a convex 14-1-2, by providing the lid-shaped filter 17-3 with a convex 17-7 matching that convex, the scattering of powder 4 due to the mounting of the lid 14-1 can be reduced at the next step of mounting and joining the lid 14-1. The convex 17-7 may be provided either by machining the filter 17-3 or providing the deaerator frame 17-1 with a convex having no filtering function.

FIG. 5 shows a configuration in which the concave 14-1-1 is located at the center of the lid 14-1. In such a configuration having the concave 14-1-1 in the lid 14-1, it is difficult to sufficiently load the concave 14-1-1, but the presence of the concave 17-6, shaped in substantially the same shape as the concave 14-1-1, in the lid-shaped filter 17-3 enables powder 4 to be so shaped as to match the lid-shaped filter 17-3 by deaeration, and accordingly sufficient filling of the concave 14-1-1 can be accomplished.

On the other hand, the convex 14-1-2 is disposed on a side edge of the lid 14-1. In such a configuration having the convex 14-1-2 on a side edge of the lid 14-1, as powder 4 is shoved out by the convex 14-1-2 of the lid 14-1 at the step of fitting the lid 14-1 to the powder storage part 14-2, scattering of the powder 4 is apt to occur. However, the presence of the convex 17-7, shaped in substantially the same shape as the lid 14-1, on the deaerator 17 enables the powder 4 in the part corresponding to the convex 14-1-2 of the lid 14-1 to be removed in advance, resulting in reduced scattering of powder 4.

Thus, the reduced scattering of the powder 4 serves to prevent powder 4 from being wastefully consumed and from being caught in the joint between the lid 14-1 and the powder storage part 14-2, resulting in increased stability of the adhesion between the lid 14-1 and the powder storage part 14-2.

In this embodiment, the negative pressure from the negative pressure source may be in a range from −5 to −10 kPa. In a deaeration test using the deaerator 17, the filled quantity of powder per unit cubic measure was successfully raised from 0.35 g/cm$^3$ to 0.50 g/cm$^3$. Thus, the filled quantity of powder in a filling container of 1000 cm$^3$ in capacity was increased from 350 g to 500 g.

(Embodiment 4)

Next, a fourth exemplary embodiment of the invention will be described.

Figure 6:
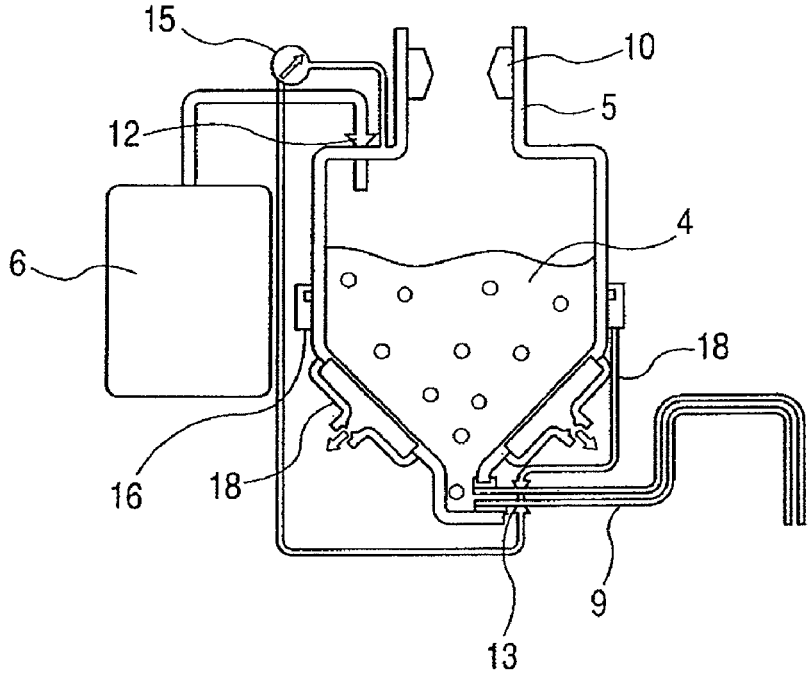
FIG. 6 illustrates a filling apparatus in a fourth exemplary embodiment.

FIG. 6 illustrates an example of filling apparatus in a fourth exemplary embodiment. Referring to FIG. 6, the powder reservoir 1, pressure hopper 5, compressor 6, carrying tube 9, powder intake valve 10, pressurizing valve 12, powder discharge valve 13, internal pressure gauge 15, load cell 16 and some other constituent elements are the same as their respective counterparts in Embodiment 1, and therefore their description will be dispensed with. The same kind of powder referred to in the description of Embodiment 1 can be used as powder 4.

A characteristic aspect of the filling apparatus, which is the fourth embodiment, lies in that a deaerator 18 is disposed on the circumferential face of the conically shaped lower part of the pressure hopper 5.

Figure 7:
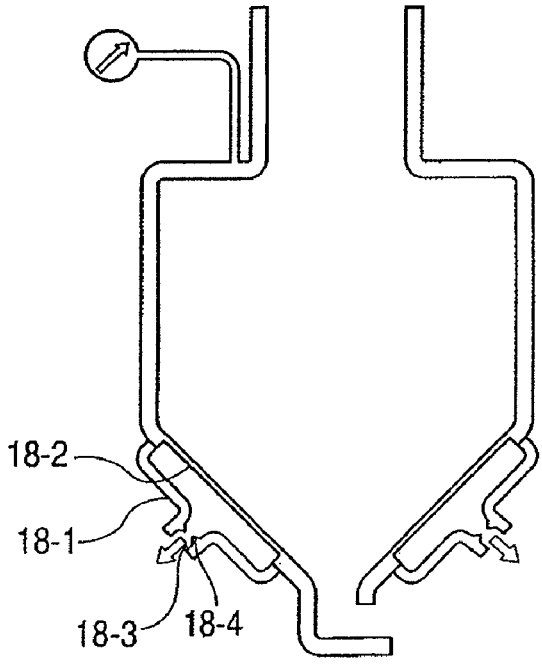
FIG. 7 illustrates details of a deaerator 18 in the fourth exemplary embodiment.

The configuration of the deaerator 18 will be described with reference to FIG. 7.

The deaerator 18 has a deaerator frame 18-1, a filter (deaerating filter) 18-2, a negative pressure connector 18-3 and a deaeration valve 18-4.

A five-layered metal sintered filter, similar to the filter of the deaerator 17 described in connection with Embodiment 3, was used as the deaerating filter 18-2 in this embodiment, the filter is not limited to this configuration either. Any configuration which does not pass powder 4 but does pass gas can be used as the deaerating filter 18-2.

Nor is there any particular limitation regarding the deaeration valve 18-4. Any valve that can secure an airtight state can be used for this purpose, and a pinch valve was used in this embodiment.

Next, a filling method using this apparatus will be described.

Powder 4 stored in the powder reservoir 1 is carried by the carrying unit 2 to the pressure hopper 5 disposed underneath. After a prescribed quantity of powder 4 has been carried to the pressure hopper 5, the deaeration valve 18-4 is opened to deaerate the powder 4 in the pressure hopper 5. The deaeration may be carried out while powder 4 is being carried to the pressure hopper 5.

After the deaeration has been carried out for a prescribed period of time, the deaeration valve 18-4 and the powder intake valve 10 are closed, the interior of the pressure hopper 5 is made airtight, followed by pressurizing of the interior of the pressure hopper 5 by the compressor 6 and the pressurizing valve 12. When the internal pressure gauge 15 detects the reaching of a prescribed pressure within the pressure hopper 5, a signal is sent to the powder discharge valve 13, which is then opened to start filling of powder 4.

As the rest of the control is the same as in the first exemplary embodiment, its description will be dispensed with.

Where the deaerator 18 described above is to be used, the deaeration may be accomplished in a pressure range from −5 to −10 kPa.

In a test of this embodiment, after deaeration was carried out by using the deaerator 18 at −10 kPa, filling in the same way as in Embodiment 1 was accomplished by applying a lead-in pressure of 40 kPa to the pressure hopper, and the apparent bulk density of powder discharged from the carrying tube 9 was successfully raised from 0.35 g/cm$^3$, the apparent bulk density achieved without deaeration, to 0.40 g/cm$^3$.

(Embodiment 5)

Next, a fifth exemplary embodiment of the invention will be described.

Figure 9:
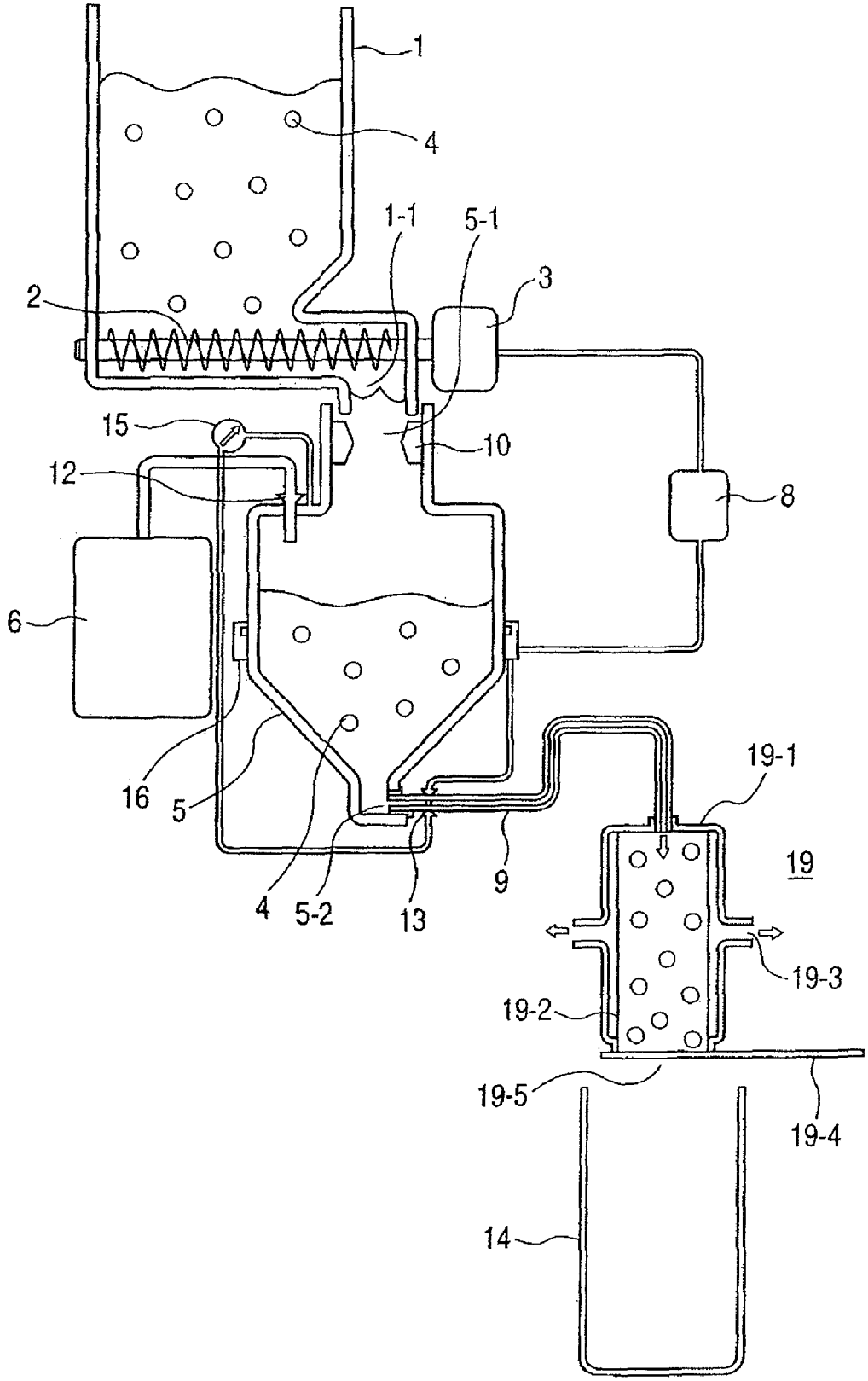
FIG. 9 is a schematic diagram of a (whole) filling apparatus in a fifth exemplary embodiment.

FIG. 9 illustrates an example of filling apparatus in a fifth exemplary embodiment. Referring to FIG. 9, the powder reservoir 1, pressure hopper 5, compressor 6, driving control device 8, carrying tube 9, powder intake valve 10, pressurizing valve 12, powder discharge valve 13, internal pressure gauge 15, load cell 16 and some other constituent elements are the same as their respective counterparts in Embodiment 1, and therefore their description will be dispensed with. The same kind of powder referred to in the description of Embodiment 1 may be used as powder 4, but in this embodiment a magnetic one-component toner was used.

A characteristic aspect of the filling apparatus, which is the fifth embodiment, lies in that a reservoir for storing powder is disposed between the pressure hopper and the filling container.

Next, the configuration of the reservoir 19 will be described.

The reservoir 19 has a reservoir frame 19-1, a reservoir filter 19-2, a connecting part 19-3, a shutter 19-4 and a reservoir powder outlet 19-5. The reservoir 19 has a cylindrical shape of 100 mm in inner diameter, and the reservoir powder outlet 19-5 is also 100 mm in inner diameter. On the other hand, the matching filling container 14 has a cylindrical shape of 120 mm in inner diameter.

A five-layered metal sintered filter, similar to the filter of the deaerator 17 described in connection with Embodiment 3, is used as the reservoir filter 19-2 in this embodiment, the filter is not limited to this configuration either. Any configuration which does not pass powder 4 but does pass gas can be used as the reservoir filter 19-2.

The shutter 19-4 controls the reservoir powder outlet 19-5, disposed underneath the reservoir 19, between a sealed state and an unsealed state by sliding one way or the other.

Next, a filling method using this apparatus will be described also with reference to FIG. 9.

Powder 4 is carried to the reservoir 19 via the carrying tube 9 by opening the powder discharge valve 13 with the pressure of air injected into the pressure hopper 5. Then, as the reservoir powder outlet 19-5 of the reservoir 19 is closed airtight by the shutter 19-4, powder 4 can be filled into the reservoir 19 without inviting scattering of the powder. By connecting the connecting part 19-3 provided on the reservoir 19 to the negative pressure source, powder 4 can be filled while deaerating the interior of the reservoir 19 via the reservoir filter 19-2. Therefore, powder 4 is deaerated while the reservoir 19 is being filled, with the result that the apparent density of powder 4 is increased while its volume decreases. On the other hand, as powder 4 continues to be filled into the reservoir 19 via the carrying tube 9 in that while, the volume decrement of powder 4 is immediately compensated for, with the result that powder 4 can be filled densely and quickly. Although FIG. 9 illustrates a configuration in which the interior of the reservoir is deaerated by the reservoir filter 19-2 and the connecting part 19-3, if deaeration of the interior of the reservoir 19 is the sole purpose, the connecting part 19-3 is dispensable. In this case, the interior of the reservoir 19 is not subjected to forced deaeration, but the pressure from the pressure hopper 5 causes powder 4 to be pressed against the reservoir filter 19-2 when it is filled, resulting in relatively dense filling.

Figure 10A:
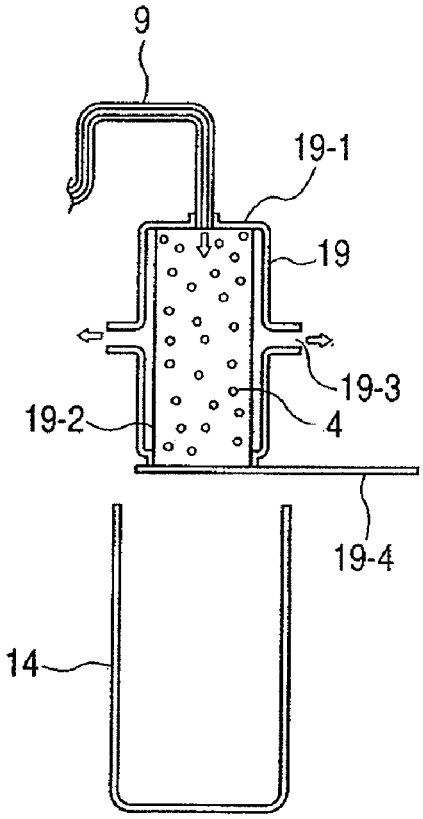
FIG. 10A shows the configuration of a reservoir 19 in the fifth exemplary embodiment.
Figure 10B:
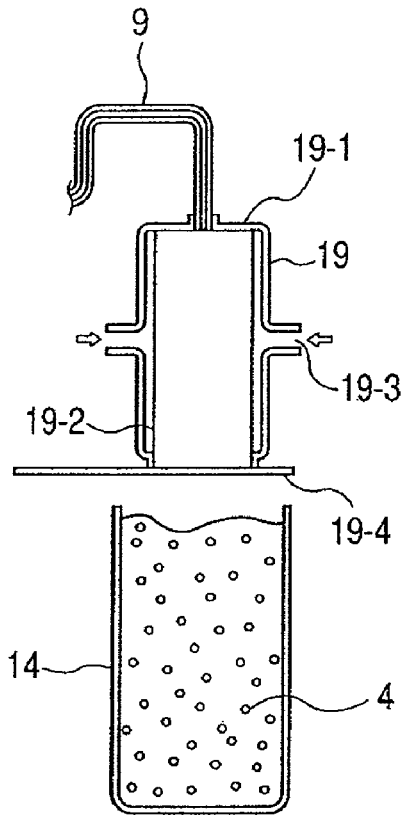
FIG. 10B also illustrates the configuration of the reservoir 19 in the fifth exemplary embodiment.

Next, how powder 4 filled in the reservoir 19 is filled into the filling container 14 will be described with reference to FIGS. 10A and 10B. After detection of the filling of a prescribed quantity of powder 4, the powder valve 13 is closed. The state of the reservoir 19 then is illustrated in FIG. 10A. After that, powder 4 in the reservoir 19 is filled into the filling container 14 by opening the shutter 19-4. The connecting part 19-3 may as well be connected to the pressure source at the same time as the opening of the shutter 19-4 to inject, conversely, air into the reservoir 19 via the reservoir filter 19-2. The injection of air causes powder 4 stuck to the surface of the reservoir filter 19-2 by negative pressure to be peeled off the reservoir filter 19-2 and thereby enables the quantity of powder 4 remaining stuck to the reservoir filter 19-2 to be reduced. It is further possible to prevent the reservoir filter 19-2 to become clogged, resulting in an extended service life of the reservoir filter 19-2. The ventilation performance of the reservoir filter 19-2 can also be maintained, with the result of improved accuracy of filling and stabilization of filling over a long period. In a test without injection of air, repeated filling into the reservoir 19 was led to a phenomenon in which filling stopped on the way and the filled quantity which had been previously achieved could no longer be attained. Continued use of the reservoir filter 19-2 in that state caused the meshes of the reservoir filter 19-2 to be fully clogged with powder 4, which could not be removed by washing with air. In that state, the reservoir filter 19-2 had to be replaced, and eventually the service life of the reservoir filter 19-2 could be extended by injecting air into the reservoir filter 19-2 after the powder filling.

Upon opening of the shutter 19-4, powder 4 begins falling and being filled by gravity from the reservoir 19 into the filling container 14. Observation of the process of filling then reveals that, as powder 4 falls in its state of remaining compacted in the reservoir, it can hardly involve air into its falling action, with the result that the powder is filled into the filling container 14 without suffering a drop in bulk density. The state of the reservoir 19 and the filling container 14 then is illustrated in FIG. 10B. Vibrating the filling container 14 while it is being filled serves to level the surface of powder 4, and therefore can prevent powder 4 from scattering when the lid is fitted and be expected to help enhance the filling rate.

Figure 11:
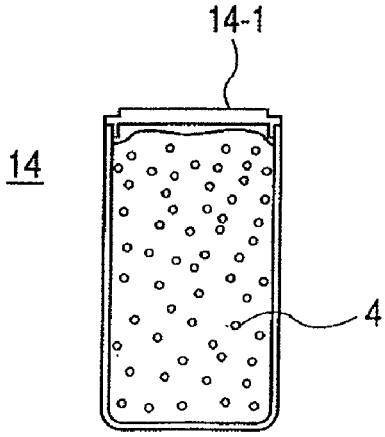
FIG. 11 illustrates the configuration of a filling container 14 in the fifth exemplary embodiment.

As the inner diameter of the filling container 14 and that of the filling inlet is 120 mm against the 100 mm inner diameter of the reservoir 19, powder 4 can be prevented from scattering out of the filling container 14 when it is filled from the reservoir 19 into the filling container 14. A sealing member to seal the joint between the reservoir 19 and the filling container 14 may be separately provided on either the reservoir 19 side or the filling container 14 side. Upon full filling of the filling container 14 with powder 4, the container is sealed by sticking the lid 14-1, and the filling into the filling container 14 is thereby completed. This state is illustrated in FIG. 11.

In testing this configuration, a filling apparatus equipped with a reservoir 19 of 410 mm in height and 3200 $cm^3$ in capacity provided with a filter throughout its inner circumference of 100 mm was used, and a magnetic one-component toner was filled. The filled quantity in the reservoir 19 was 2300 g to 2370 g, and the filled quantity per unit capacity was about 0.72 $g/cm^3$ to 0.74 $g/cm^3$. When a cylindrical container of 120 mm in inner diameter, 300 mm in height and 3390 $cm^3$ in capacity was used as the filling container 14, about 0.68 $g/cm^3$ to 0.70 $g/cm^3$ in unit capacity was successfully filled into the filling container 14 even when powder was dropped 300 mm and then filled. The filling was carried out at 100 kPa in lead-in pressure to the pressure hopper 4 and at −20 kPa in deaerating pressure for the reservoir 19, and a silicone resin tube of 15 mm in inner diameter was used as the carrying tube.

On the other hand, even when the interior of the reservoir 19 was not deaerated, the filled quantity in the reservoir 19 was about 2240 g, and the filled quantity per unit capacity in the reservoir 19 was about 0.70 $g/cm^3$.

When the magnetic one-component toner filled in the filling container as described was let pass a sieve of 38 μm in opening (400 mesh), the number of particles remaining on the sieve after the filling manifested no increasing trend compared with that after filling without going through the reservoir.

Although the configuration of this Embodiment 5 is supposed to have a reservoir added to the filling apparatus like that of Embodiment 1, a configuration having a reservoir added to the filling apparatus like that of any of Embodiments 2 through 4 is also acceptable.

(Embodiment 6)

Next, a sixth exemplary embodiment of the invention will be described.

Figure 12:
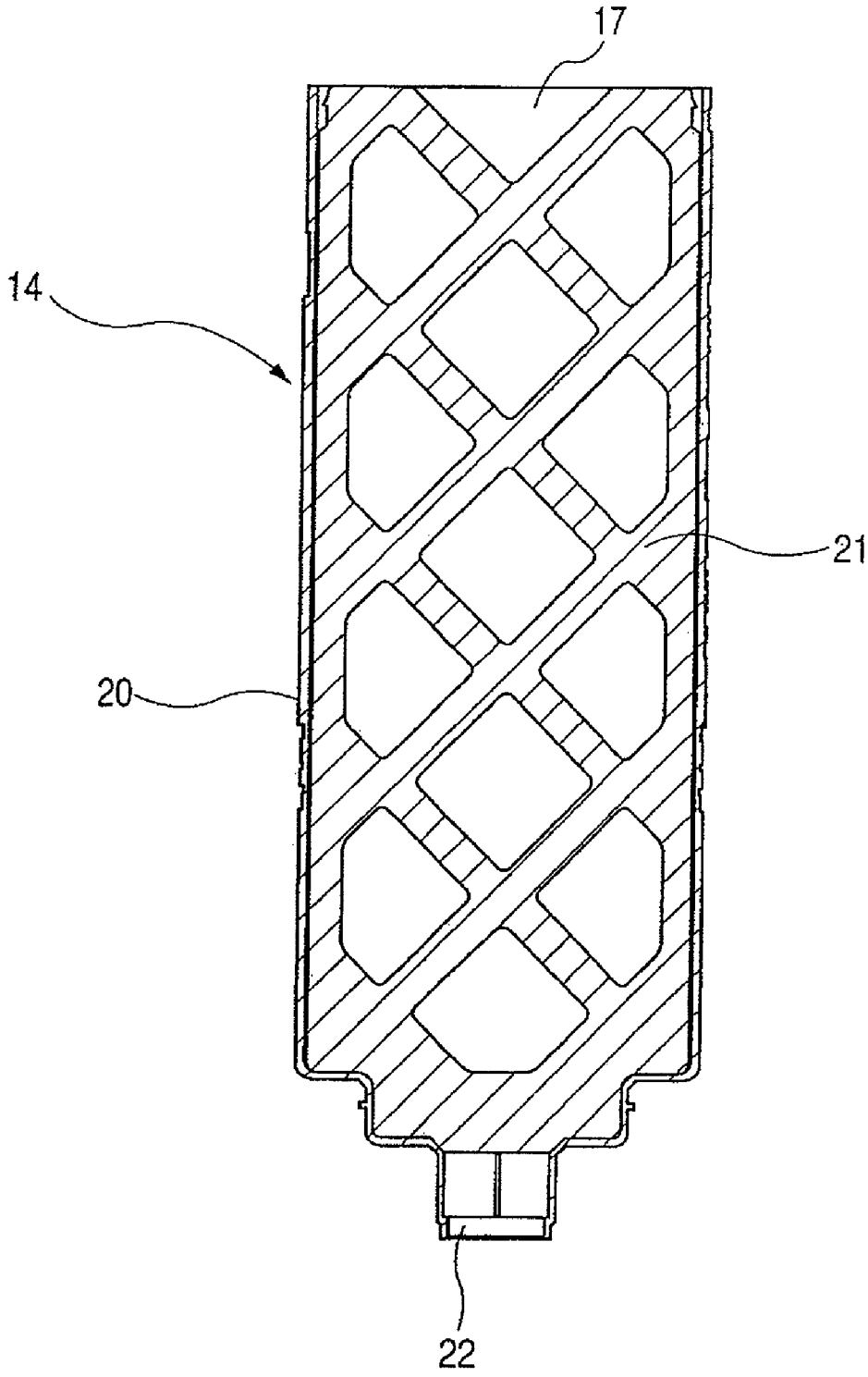
FIG. 12 shows the configuration of the filling container 14 in a sixth exemplary embodiment.

A characteristic aspect of the sixth embodiment lies in that a filling container 14 illustrated in FIG. 12 is so connected to the rear end of the carrying tube 9 of FIG. 1 that the deaerator of the filling container is positioned higher than the inlet of the filling container.

First, the configuration of the filling container 14 will be described with reference to FIG. 12.

The filling container 14 is provided with a powder storing portion 20 which accommodates powder, a carrying member 21 which carries the powder inside while stirring it, and a filling container powder inlet 22 equipped with a connecting part with the carrying tube. Powder 4 is filled from the filling container powder inlet 22 into the powder storing portion 20. When powder 4 is to be filled, the filling container powder inlet 22 and deaerator 17 may desirably be in a fully closed state with any of its gaps being with a sealing member or the like (not shown) so that the powder 4 may not leak out of the powder storing portion 20. There is no particular limitation regarding the configuration of the illustrated carrying member 21. The inner wall of the powder storing portion 20 may have a spiral groove (not shown) so that the powder inside can be carried by the rotation of the filling container on its axis or orbital revolution of the filling container.

Figure 13:
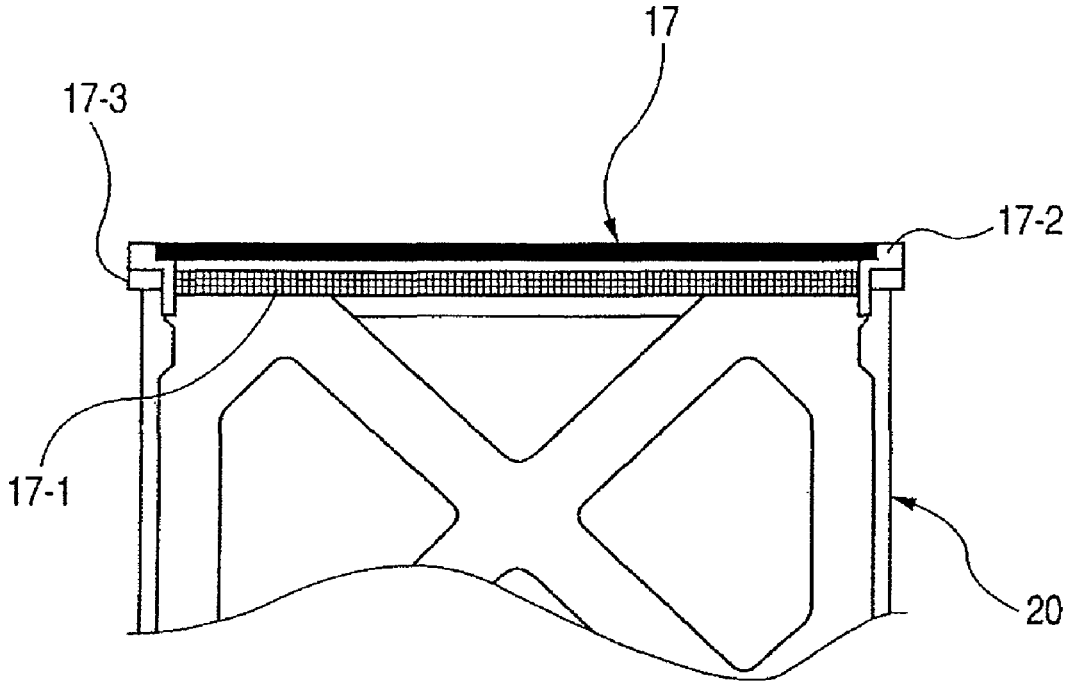
FIG. 13 illustrates details of the deaerator of the filling container in the sixth exemplary embodiment.

Next, the configuration of the filling container deaerator 17 will be described with reference to FIG. 13.

Filling is accomplished in such a way that the filling container deaerator 17 is positioned higher than the filling container powder inlet 22 connected to the carrying tube through which powder 4 is filled into the powder storing portion 20 of the filling container 14. As shown in FIG. 13, the filling container deaerator 17 mainly comprises a filling container deaerating filter 17-1 which intercepts powder 4 and passes gas in the powder storing portion 20, a frame 17-2 which is integrated with the filling container deaerating filter 17-1 and intended for connection to the powder storing portion 20, and a sealing member 17-3 which prevents powder 4 from leaking out of the connecting part between the powder storing portion 20 and the filling container deaerator 17. Thus, only the gas in the powder storing portion 20 can be removed without fail by disposing in a fully sealed state the filling container deaerating filter 17-1 in the filling container deaerator 17.

By arranging the filling container deaerator 17 in a higher position than the filling container powder inlet 22 in the powder storing portion 20, deaeration can be accomplished smoothly and the filling density of powder 4 can be enhanced. It is desirable to connect the filling container powder inlet 22 to the lower end of the powder storing portion 20 in the vertical direction and the filling container deaerator 17 to the upper end of the powder storing portion 20 in the vertical direction, opposing the filling container powder inlet 22. In this embodiment, powder is filled in such a configuration.

Although a five-layered metal sintered filter, similar to the filter of the deaerator 17 described in connection with Embodiment 3, is used as the filling container deaerating filter 17-1 in this embodiment, the configuration of this filter is not limited to this type. It is sufficient for the filling container deaerating filter 17-1 to intercept powder 4 and to pass only gas. Though no deaerator as such is used in this embodiment, it is also conceivable to perform positive deaeration with a deaerator connected to the filling container deaerating filter.

In a test of this embodiment, a magnetic one-component toner was filled through the filling container powder inlet while deaerating the interior of the filling container at 50 kPa in lead-in pressure to the pressure hopper, high density filling of 0.70 g/cm$^3$ was accomplished smoothly.

Although the configuration of this Embodiment 6 is supposed to have a different filling container from the filling apparatus of Embodiment 1, the configuration of the filling apparatus of any of Embodiments 2 through 4 may have a different filling container.

(Embodiment 7)

Next, a seventh exemplary embodiment of the invention will be described.

Figure 14:
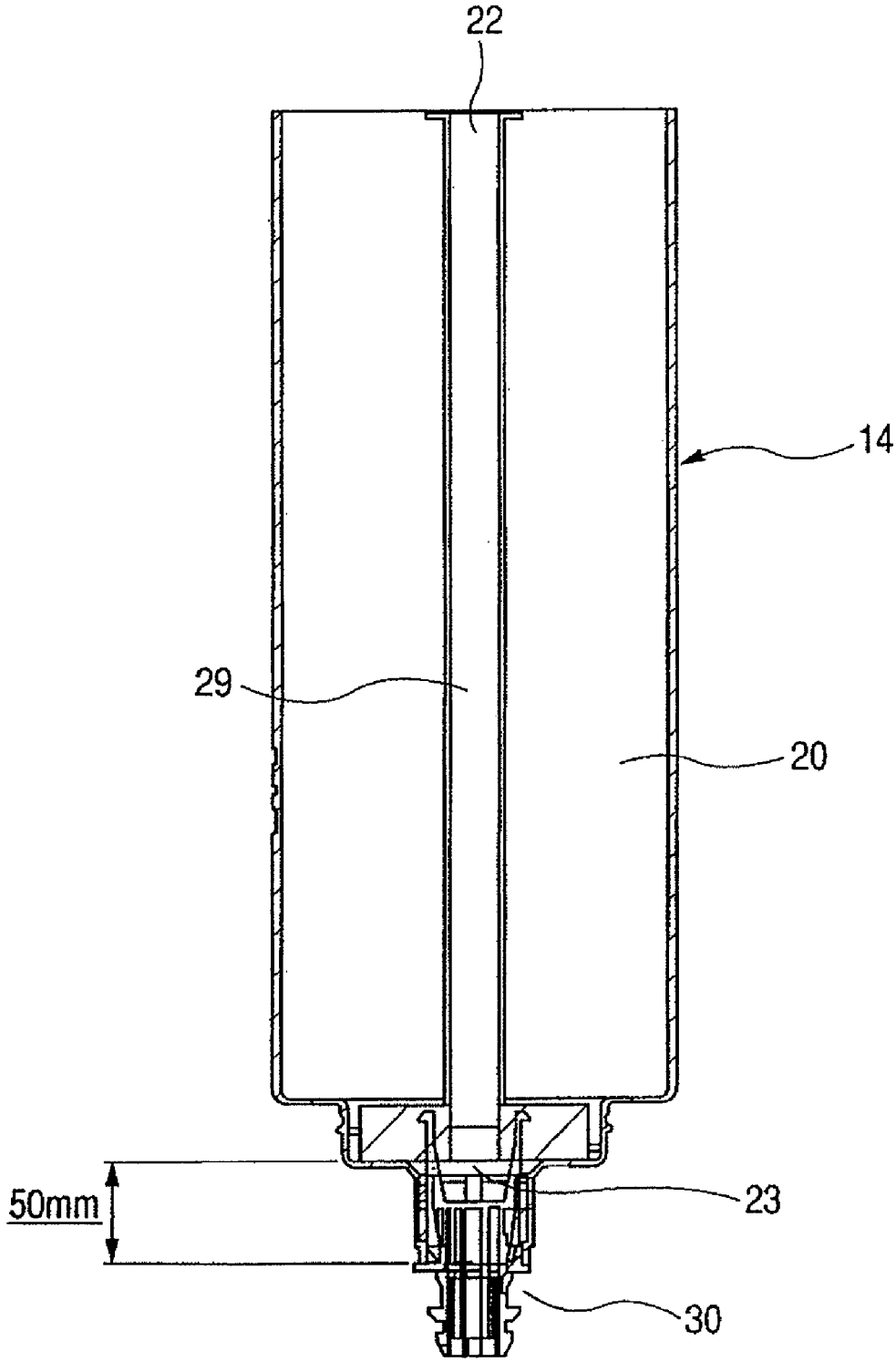
FIG. 14 illustrates the configuration of the filling container 14 in a seventh exemplary embodiment.
Figure 15:
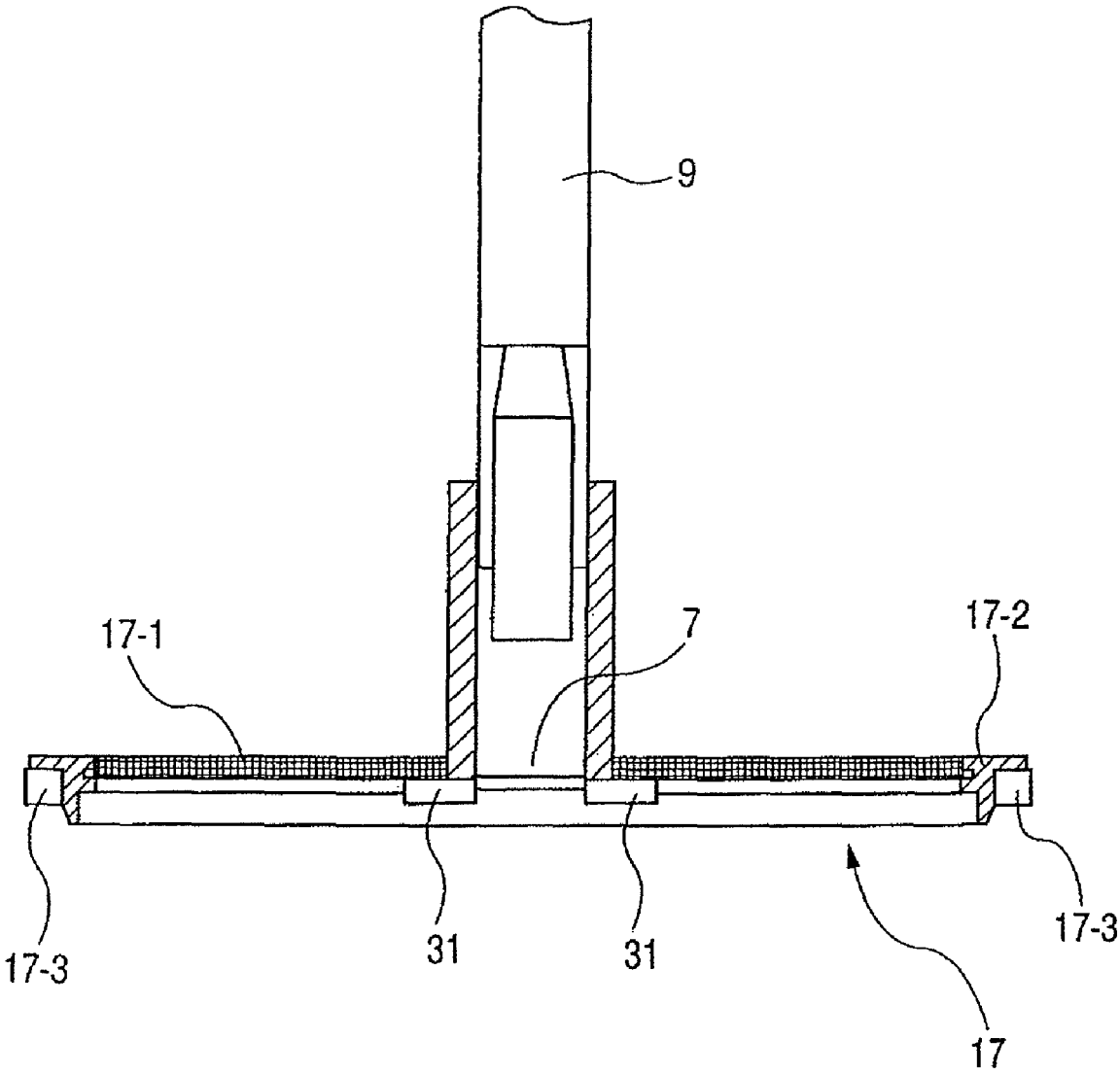
FIG. 15 illustrates details of the deaerator of the filling container in the seventh exemplary embodiment.

A characteristic aspect of the seventh embodiment lies in that a filling container illustrated in FIG. 14, to which a filling container deaerator illustrated in FIG. 15 is fitted, is connected to the rear end of the carrying tube 9 in FIG. 1.

First, the configuration of the filling container 14 will be described with reference to FIG. 14 and FIG. 15.

As illustrated in FIG. 14, the filling container 14 is provided with the powder storing portion 20, a filling assisting tube 29 extending downward from above the powder storing portion 20, and a sealing cap 30. It is preferable for a regulator (not shown) within the powder storing portion 20 to keep the lower end 23 of the filling assisting tube 29 and the bottom of the powder storing portion 20 at a distance of 1 to 120 mm between each other, more preferable at a distance of 15 to 85 mm. Within this range, restraining of powder scattering and smooth filling can be achieved at the same time with particularly satisfactory results.

With the filling container 14 in the filling posture the upper end 22 of the filling assisting tube 29 is connected to a filling container powder inlet 7. Powder 4 is let in through the filling container powder inlet 7, and filled into the powder storing portion 20 from the lower end 23 of the filling assisting tube 29 via the inside of the filling assisting tube 29 in such a way that the layer face of powder 4 gradually rises from the bottom of the powder storing portion 20. The filling container deaerator 17 is connected to the top of the powder storing portion 20 and, while gas in the powder storing portion 20 is being removed from the filling container deaerator 17 to outside the powder storing portion 20, powder 4 is filled into the powder storing portion 20. In the tested example of this embodiment, the powder storing portion was 350 mm long in the longer direction, the filling assisting tube 29 was 15 mm in inner diameter and 300 mm long in the longer direction, and the distance between the lower end 23 of the filling assisting tube 29 and the bottom of the powder storing portion 20 was about 50 mm. A tube of 15 mm in inner diameter was used as the carrying tube 9.

Next, the configuration of the filling container deaerator 17 will be described.

The filling container deaerator 17 is so arranged in the upper part of the powder storing portion 20 as to stay away in its filling posture from the upper end 22 of the filling assisting tube 29 to which the filling container powder intake 7 is connected. As illustrated in FIG. 15, the filling container deaerator 17 mainly comprises the filling container deaerating filter 17-1 which intercepts powder 4 and passes gas in the powder storing portion 20, the frame 17-2 which is integrated with the filling container deaerating filter 17-1 and intended for connection to the powder storing portion 20, and the sealing member 17-3 which prevents powder 4 from leaking out of the connecting part between the powder storing portion 20 and the filling container deaerator 17. Thus, only the gas in the powder storing portion 20 can be removed without fail and powder scattering from the powder storing portion 20 can be prevented by connecting the filling container deaerating filter 17-1 to the filling container deaerator 17 in a fully sealed state. The frame 17-2 may have an inlay shape partly entering into the inner circumference of the powder storing portion 20 to facilitate fitting to the powder storing portion 20.

The filling container powder inlet 7 connected to the tip of the carrying tube 9, penetrating the filling container deaerating filter 17-1, is integrated with the filling container deaerator 17. A tight seal 31 for sealing and connecting the filling assisting tube 29 and the filling container powder inlet 7 is disposed at the tip of the filling container powder inlet 7. This tight seal 31 precisely guides powder 4 ejected from the filling container powder inlet 7 into the filling assisting tube 29 without allowing it to leak out of the connecting part. The tight seal 31 here may as well be disposed at the upper end of the filling assisting tube 29 to be described afterwards.

Although a five-layered metal sintered filter, similar to the filter of the deaerator described in connection with Embodiment 3, is used as the filling container deaerating filter 17-1 in this embodiment, the configuration of this filter is not limited to this type. It is sufficient for the filling container deaerating filter 17-1 to intercept powder 4 and to pass only gas. Though no deaerator as such was used in this embodiment, it is also conceivable to perform positive deaeration with a deaerator connected to the filling container deaerating filter.

In a test of this embodiment, a magnetic one-component toner was filled through the filling container powder inlet while deaerating the interior of the filling container at 50 kPa in lead-in pressure to the pressure hopper, high density filling of 0.69 g/cm$^3$ was accomplished smoothly.

Although the configuration of this Embodiment 7 is supposed to have a different filling container from the filling apparatus of Embodiment 1, the configuration of the filling apparatus of any of Embodiments 2 through 4 may have a different filling container.

This application claims its priority on the basis of Japanese Patent Application No. 2006-052216 filed on Feb. 28, 2006, the contents of which are incorporated herein by reference.

What is claimed is:

1. A powder filling apparatus for filling a filling container with powder, the powder filling apparatus comprising:

a pressure hopper and an auxiliary container, wherein:

the pressure hopper includes a discharger for discharging powder and a gas inlet positioned above at least the surface of a powder layer formed by the powder in the pressure hopper, the powder layer is so formed as to blockade the discharger in the pressure hopper, and the inside of the pressure hopper is pressurized by leading in gas through the gas inlet in a state in which the discharger is closed, and the powder layer, so formed as to blockade the discharger, is discharged by opening the discharger after the pressurization thereby to utilize that pressure to fill the powder into the filling container;

the auxiliary container communicates with the pressure hopper at a connecting part and increases the volume of the space which can be pressurized, the auxiliary container accepts gas, which is provided from the gas inlet to the pressure hopper, through the connecting part in a state in which the discharger is closed, and the auxiliary container shoves out pressurized gas in the auxiliary container to the pressure hopper in a state in which the discharger is opened.

2. The powder filling apparatus according to claim 1, further comprising a filter, which passes air and prevents powder from entering into the auxiliary container, and is disposed at the connecting part.

3. A powder filling method executed by using a powder filling apparatus including: (i) a pressure hopper including a discharger for discharging powder into a filling container and a gas inlet positioned above at least the surface of a powder layer formed by the powder in the pressure hopper, the powder layer is so formed as to blockade the discharger in the pressure hopper, and (ii) an auxiliary container which communicates with the pressure hopper at a connecting part and increases the volume of the space which can be pressurized, wherein the auxiliary container accepts gas, which is provided from the gas inlet to the pressure hopper, through the connecting part in a state in which the discharger is closed, wherein the auxiliary container shoves out pressurized gas in the auxiliary container to the pressure hopper in a state in which the discharger is opened, and wherein the method comprises the step of:

pressurizing the inside of the pressure hopper by leading in gas through the gas inlet in a state in which the discharger is closed, and the powder layer, so formed as to blockade the discharger, is discharged by opening the discharger after the pressurization thereby to utilize that pressure to fill the powder into the filling container.

4. The powder filling method according to claim 3, wherein an auxiliary container filter, which passes air and prevents powder from entering into the auxiliary container, is disposed at the connecting part.

* * * * *